US012329304B2

(12) United States Patent
Alletto, Jr.

(10) Patent No.: US 12,329,304 B2
(45) Date of Patent: Jun. 17, 2025

(54) PILLOW WITH GUSSET HAVING MULTIPLE POROSITY PORTS

(71) Applicant: Bedgear, LLC, Farmingdale, NY (US)

(72) Inventor: Eugene Alletto, Jr., Glen Head, NY (US)

(73) Assignee: Bedgear, LLC, Farmingdale, NY (US)

( * ) Notice: Subject to any disclaimer, the term of this patent is extended or adjusted under 35 U.S.C. 154(b) by 0 days.

(21) Appl. No.: 14/747,591

(22) Filed: Jun. 23, 2015

(65) Prior Publication Data

US 2016/0166092 A1 Jun. 16, 2016

Related U.S. Application Data

(60) Provisional application No. 62/091,000, filed on Dec. 12, 2014.

(51) Int. Cl.
*A47G 9/10* (2006.01)
*A47G 9/02* (2006.01)

(52) U.S. Cl.
CPC ..... *A47G 9/10* (2013.01); *A47G 9/0253* (2013.01); *A47G 9/1036* (2013.01); *A47G 9/02* (2013.01); *A47G 2009/1018* (2013.01); *A47G 9/1027* (2013.01); *A47G 9/1054* (2013.01)

(58) Field of Classification Search
CPC ..... A47G 9/10; A47G 9/0253; A47G 9/1036; A47G 9/0238; A47G 9/1027; A47G 9/1054; A47G 9/0246; A47G 9/02; A47G 2009/1018; A41D 27/28; A41D 31/102; A41D 31/00; A41D 31/14; A41D 31/02; A41D 1/00; A41D 1/0017; A41D 2500/20; D03D 15/217; D03D 15/225; D03D 15/283; D03D 15/292; D03D 15/37; D03D 15/49; D03D 15/68; D03D 15/47; D03D 27/08; A41B 2500/20
See application file for complete search history.

(56) References Cited

U.S. PATENT DOCUMENTS 1,212,515 A 1/1917 Deavitt
1,876,591 A 9/1932 Bawden
2,128,978 A 9/1938 Akin
(Continued)

FOREIGN PATENT DOCUMENTS

CN 201798389 U 4/2011
CN 202445678 9/2012
(Continued)

OTHER PUBLICATIONS

S. Munoz, Shopping Around/Antimicrobial Sheets, Wall Street Journal, Jan. 4, 2007.
Silver used by big business to make antimicrobial clothing, http://www.nanobiosilver.com/applications.html (Jul. 2008).
C. Gromer, "Smart Threads Today's Technology Driven Fabrics Coddle You While Battling the Elements", Popular Mechanics, pp. 78-81 (Apr. 2004).
(Continued)

*Primary Examiner* — Justin C Mikowski
*Assistant Examiner* — Morgan J McClure
(74) *Attorney, Agent, or Firm* — Sorell, Lenna & Schmidt, LLP

(57) ABSTRACT

A pillow is provided that includes a first panel having an edge defining a perimeter. A second panel has an edge defining a perimeter. A gusset joins the first and second panels. The gusset has a first porosity. The gusset includes a plurality of ports. The ports each have a second porosity that is greater than the first porosity.

29 Claims, 15 Drawing Sheets

(56) References Cited

U.S. PATENT DOCUMENTS 2,217,999 A * 10/1940 De Woskin ..... A47G 9/0253 5/490
2,566,790 A 9/1951 Bloomfield
2,588,695 A * 3/1952 Brady ..... B65D 29/00 139/389
2,765,480 A 10/1956 Mueller
2,784,420 A 3/1957 Moltane
2,807,033 A * 9/1957 Austen ..... A47C 20/026 5/725
2,927,331 A 3/1960 Ruiz
3,103,669 A 9/1963 Mundis
3,109,182 A * 11/1963 Gordon ..... A47C 27/22 5/636
3,183,527 A 5/1965 Turner
3,325,832 A * 6/1967 Malicki ..... A47G 9/0238 5/487
3,438,069 A 4/1969 Long
3,507,727 A * 4/1970 Marshack ..... B29C 63/18 2/24
3,521,310 A 7/1970 Greenawalt
3,882,871 A 5/1975 Taniguchi
4,232,415 A 11/1980 Webber
4,280,342 A 7/1981 Eng et al.
4,370,765 A 2/1983 Webber
4,644,591 A 2/1987 Goldberg
4,665,575 A * 5/1987 Raught ..... A47C 21/046 441/128
4,767,419 A 8/1988 Fattore
4,768,247 A * 9/1988 Beier ..... A47G 9/0253 5/490
4,788,730 A * 12/1988 Bexton ..... A61G 5/1043 5/654
4,903,357 A 2/1990 Kruchen et al.
4,914,772 A * 4/1990 Difloe ..... A47C 7/66 297/452.43
4,922,565 A 5/1990 Blake
5,010,611 A 4/1991 Mallett
5,086,530 A 2/1992 Blake
5,148,564 A 9/1992 Reder
5,193,236 A * 3/1993 Komuro ..... A47G 9/10 5/636
5,385,036 A 1/1995 Spillane et al.
5,471,687 A * 12/1995 Vierra ..... A47G 9/086 5/413 AM
5,509,157 A 4/1996 Story
5,518,803 A * 5/1996 Thomas ..... B44D 2/00 427/282
5,535,468 A * 7/1996 Mallernee ..... A47G 9/10 5/638
5,566,407 A 10/1996 Lien
5,575,025 A 11/1996 Peters
5,577,276 A 11/1996 Nicholson et al.
5,642,543 A 7/1997 Huntley
5,642,545 A 7/1997 Howard
5,699,571 A 12/1997 Yowell
5,706,534 A 1/1998 Sherman
5,727,266 A * 3/1998 Pang ..... A47G 9/0253 5/490
D394,366 S 5/1998 Graebe et al.
D396,981 S 8/1998 Laidlaw
5,787,534 A 8/1998 Hargest et al.
5,806,112 A 9/1998 Harms
5,855,031 A 1/1999 Swift, Jr.
5,857,232 A 1/1999 Mahdavi
5,881,408 A 3/1999 Bashista et al.
5,933,885 A 8/1999 Glassford
5,937,458 A 8/1999 DeRosa
6,012,189 A 1/2000 Dudley
6,019,421 A 2/2000 Roh
6,026,330 A 2/2000 Chuang
6,039,393 A 3/2000 Roh
6,055,690 A 5/2000 Koenig
6,089,947 A 7/2000 Green
D433,851 S 11/2000 Roh
6,168,495 B1 1/2001 Yoon
6,170,101 B1 1/2001 McCloud
6,178,573 B1 1/2001 Wagner et al.
6,243,895 B1 6/2001 Amin
6,302,487 B1 10/2001 Fujita et al.
6,315,364 B1 11/2001 Fujita et al.
6,347,422 B2 2/2002 Heavrin
6,371,645 B1 * 4/2002 Rusert ..... B65D 29/04 383/107
6,408,468 B1 * 6/2002 Comfort ..... A47G 9/10 5/498
6,421,857 B2 7/2002 Whatman et al.
6,438,775 B1 8/2002 Koenig
6,489,000 B1 12/2002 Ogura et al.
6,550,083 B1 4/2003 LaMantia
6,670,018 B2 12/2003 Fujita et al.
6,701,555 B1 3/2004 Ermini
6,760,935 B1 7/2004 Burton et al.
6,772,457 B1 8/2004 Alaback
6,817,030 B2 * 11/2004 Desai ..... A41B 9/00 2/67
6,859,962 B2 3/2005 Diak/Ghanem
6,979,491 B2 12/2005 Yan et al.
6,988,286 B2 * 1/2006 Schecter ..... A47G 9/10 5/645
D517,698 S 3/2006 Savage
7,007,325 B1 3/2006 Gomeh
7,013,509 B2 * 3/2006 Hickman ..... A47G 9/0253 5/485
7,055,192 B2 6/2006 Waters et al.
7,080,421 B1 7/2006 Delfs
D532,640 S 11/2006 Pressler
7,523,513 B2 4/2009 Waters et al.
7,721,367 B2 * 5/2010 Ahn ..... A47C 27/0453 5/716
D672,183 S * 12/2012 Alletto, Jr. ..... D6/601
D672,184 S * 12/2012 Alletto, Jr. ..... D6/601
D672,186 S * 12/2012 Alletto, Jr. ..... D6/601
8,646,134 B1 * 2/2014 Alletto, Jr. ..... A47G 9/1036 5/490
D713,173 S * 9/2014 Alletto, Jr. ..... D6/602
D713,174 S * 9/2014 Alletto, Jr. ..... D6/602
9,167,922 B1 * 10/2015 Holbrook ..... A47G 9/10
9,247,826 B1 * 2/2016 Holbrook ..... A47C 21/046
9,265,369 B1 * 2/2016 Beliveau ..... A47G 9/1036
D750,861 S * 3/2016 Alletto, Jr. ..... D34/21
9,352,530 B2 * 5/2016 Hansen ..... D21F 1/0036
D759,404 S * 6/2016 Alletto, Jr. ..... D6/601
D759,405 S * 6/2016 Alletto, Jr. ..... D6/601
2001/0000362 A1 4/2001 Wagner et al.
2002/0034901 A1 3/2002 Fujita et al.
2002/0178500 A1 12/2002 Koenig
2003/0056292 A1 3/2003 Fenichel
2004/0000011 A1 * 1/2004 Hsu ..... A47G 9/1027 5/644
2004/0068795 A1 * 4/2004 Hollander ..... A47G 9/10 5/502
2004/0128764 A1 7/2004 McGrath et al.
2004/0199999 A1 10/2004 Landry
2004/0231055 A1 11/2004 Sanders
2005/0034243 A1 2/2005 Carlitz
2005/0102756 A1 * 5/2005 Martin ..... A47G 9/10 5/636
2005/0132498 A1 * 6/2005 Vrionis ..... A47G 9/0246 5/737
2005/0177942 A1 8/2005 Finn et al.
2005/0217030 A1 10/2005 Seigler
2005/0278852 A1 * 12/2005 Wahrmund ..... A47G 9/10 5/636
2006/0010608 A1 1/2006 DeFranks et al.
2007/0246157 A1 10/2007 Mason
2007/0261173 A1 11/2007 Schlussel
2008/0035519 A1 * 2/2008 Swartz ..... B65D 31/145 206/522
2009/0049870 A1 2/2009 Garus
2009/0083908 A1 * 4/2009 Fry ..... A47G 9/0253 5/636
2009/0106904 A1 4/2009 Swarts

(56) References Cited

U.S. PATENT DOCUMENTS

| | | | | |
|---|---|---|---|---|
| 2010/0300455 | A1* | 12/2010 | Goff | A61F 5/56 128/845 |
| 2013/0055590 | A1* | 3/2013 | Mokos | A43B 1/04 36/45 |
| 2013/0065014 | A1* | 3/2013 | Miyagawa | D04H 3/011 428/113 |
| 2014/0096323 | A1 | 4/2014 | Alletto | |
| 2014/0109318 | A1* | 4/2014 | Loos | A47G 9/0253 5/644 |
| 2014/0189955 | A1* | 7/2014 | Alletto, Jr. | A47G 9/1027 5/636 |
| 2015/0026099 | A1* | 1/2015 | Alletto, Jr. | G06Q 90/00 705/500 |
| 2015/0114759 | A1* | 4/2015 | Alletto, Jr. | B65D 83/0811 186/57 |
| 2015/0208814 | A1* | 7/2015 | Alletto, Jr. | A47C 21/042 5/423 |
| 2016/0166092 | A1* | 6/2016 | Alletto, Jr. | A47G 9/10 5/638 |

FOREIGN PATENT DOCUMENTS

| | | | |
|---|---|---|---|
| CN | 202445678 | U | 9/2012 |
| DE | 20221416 | | 11/2005 |
| DE | 20221416 | U1 | 11/2005 |
| EP | 1222886 | A2 | 7/2002 |
| EP | 1378193 | A1 | 1/2004 |
| GB | 2270254 | | 8/1992 |
| GB | 2290959 | | 1/1996 |
| GB | 2290959 | A | 1/1996 |
| WO | 2004056237 | A2 | 7/2004 |
| WO | 20090341193 | A1 | 3/2009 |
| WO | 2016093886 | A1 | 6/2016 |

OTHER PUBLICATIONS

International Partial Search Report No. PCT/US2015/037174 dated Oct. 2, 2015.

International Preliminary Report on Patentability and Written Opinion of the International Searching Authority dated Jun. 13, 2017 of International Application No. PCT/US2015/037174 filed Jun. 23, 2015, entire document.

The State Intellectual Property Office of the People's Republic of China, Application No. 201580073077.4, 1st Office Action, mailed May 28, 2018.

Intellectual Property Office of Singapore Written Opinion, 11201704769X, Date of Written Opinion: Apr. 13, 2018.

Intellectual Property Office of Singapore Written Opinion, 11201704769X, malled Mar. 5, 2019.

Australian Government, IP Australia, Examination report No. 1 for standard patent application, Application No. 2015203722, Applicant name Bedgear, LLC, Eugene Aletto Jr., mailed Apr. 15, 2020, www.ipaustralia.gov.au.

Australian Government, IP Australia, Examination report No. 1 for standard patent application, Australian Divisional Patent Application No. 2021202280, Dated Jun. 23, 2022.

The Intellectual Property Office of New Zealand (IPONZ) https://www.iponz.govt.nz/ Patent examination report 2, Application No. 763029, Case title: Pillow With Gussett Having Multiple Porosity Ports, Date of report: Jul. 14, 2022.

China National Intellectual Property Administration (CNIPA), First Office Action (OA) Chinese Patent Application No. 202111300220.2, Date: Oct. 24, 2022.

China National Intellectual Property Administration (CNIPA), Second Office Action (OA) Chinese Patent Application No. 202111300220.2, Date: Jul. 7, 2023.

* cited by examiner

PILLOW WITH GUSSET HAVING MULTIPLE POROSITY PORTS

TECHNICAL FIELD

The present disclosure generally relates to bedding, and more particularly to pillows adapted to provide proper air flow through the pillow.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that is comfortable in order to achieve restful sleep.

People lose a significant amount of heat through their head. As such, heat builds up on a sleep surface of a pillow as a person rests their head on the pillow. Pillows have been developed to provide air flow through an interior of the pillow, such as, for example, pillows made of a breathable fabric. However, these pillows fail to sufficiently move heat away from the sleep surface of the pillow and distribute the heat in a manner that does not disrupt sleep. This disclosure describes an improvement over these prior art technologies.

SUMMARY

In one embodiment, in accordance with the principles of the present disclosure, a pillow adapted to provide proper air flow through the pillow is provided. The pillow comprises a first panel having an edge defining a perimeter. A second panel has an edge defining a perimeter. A gusset joins the first and second panels. The gusset has a first porosity. The gusset includes a plurality of ports. The ports each have a second porosity that is greater than the first porosity.

In one embodiment, in accordance with the principles of the present disclosure, the pillow comprises a first panel and a second panel opposite the first panel. The first and second panels each have a first porosity. A gusset perimetrically bounds and joins the first and second panels. The gusset has a second porosity that is greater than the first porosity. The gusset comprises a plurality of ports. The ports each have a third porosity that is greater than the second porosity. The first panel, the second panel and the gusset define a cover having an inner surface defining a chamber. An interface between the first panel and the gusset comprises a fastener configured to open to provide access to the chamber.

In one embodiment, in accordance with the principles of the present disclosure, the pillow comprises a first panel and a second panel opposite the first panel. The first and second panels each have a first porosity. A gusset perimetrically bounds and joins the first and second panels. The gusset comprises an open cell construction having a second porosity that is greater than the first porosity. The gusset comprises a plurality of ports. The ports each comprise a mesh material having a third porosity that is greater than the second porosity. The ports are spaced apart from one another. The first panel, the second panel and the gusset define a cover having an inner surface defining a chamber. An inner cover is disposed inside of the chamber. A fill material is disposed within the inner cover. An interface between the first panel and the gusset comprises a zipper configured to provide access to the chamber. The open cell construction is formed by strands defining a mesh configuration. The strands comprise polyester and are connected at points of intersection of the strands. The fill material is selected from a group consisting of a compliant material, gel and memory foam.

In one embodiment, in accordance with the principles of the present disclosure, the pillow comprises a first panel comprising opposite first and second ends extending between opposite first and second sides. The pillow includes a second panel opposite the first panel. The second panel comprises opposite first and second ends extending between opposite first and second sides. The first and second sides of the first panel engages the first and second sides of the second panel. The first and second panels each comprise a base material having a first porosity. A gusset is positioned between the first end of the first panel and the first end of the second panel and between the second end of the first panel and the second end of the second panel so as to join the first and second panels. The gusset comprises an open cell construction having a second porosity that is greater than the first porosity. The gusset comprises a plurality of ports. The ports each comprise a mesh material having a third porosity that is greater than the second porosity. The ports are spaced apart from one another. The first panel, the second panel and the gusset define a cover having an inner surface defining a chamber. An inner cover is disposed inside of the chamber. A fill material is disposed within the inner cover. An interface between the first panel and the gusset comprises a zipper configured to provide access to the chamber. The open cell construction is formed by strands defining a mesh configuration. The strands comprise polyester and are connected at points of intersection of the strands. The fill material is selected from a group consisting of a compliant material, gel and memory foam. The first and second panels each comprise a portal having a fourth porosity that is different than the first porosity, the second porosity and the third porosity.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
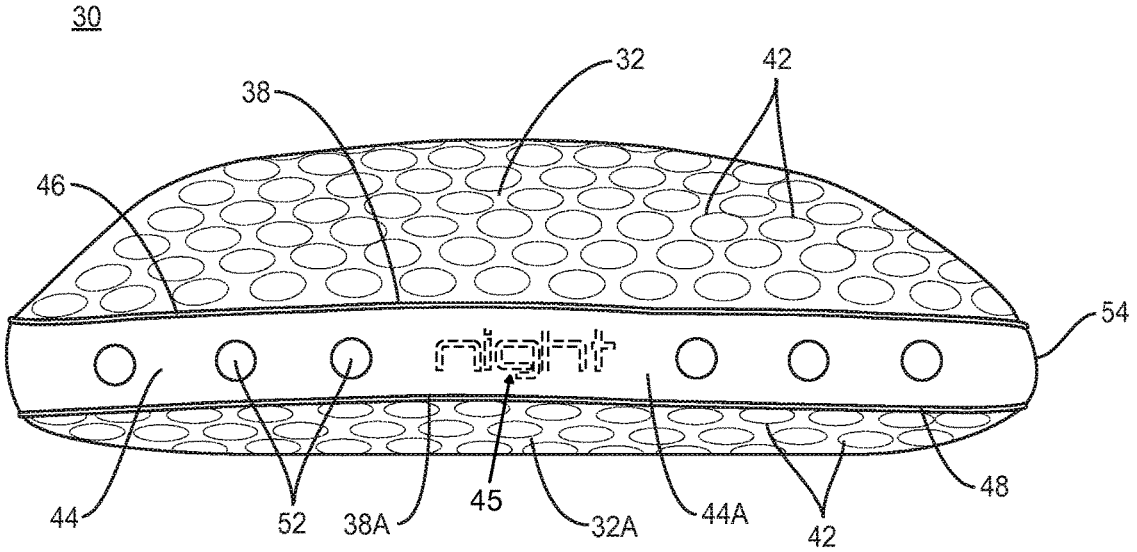
FIG. 1 is a perspective view of one embodiment of a pillow in accordance with the principles of the present disclosure.
Figure 1A:
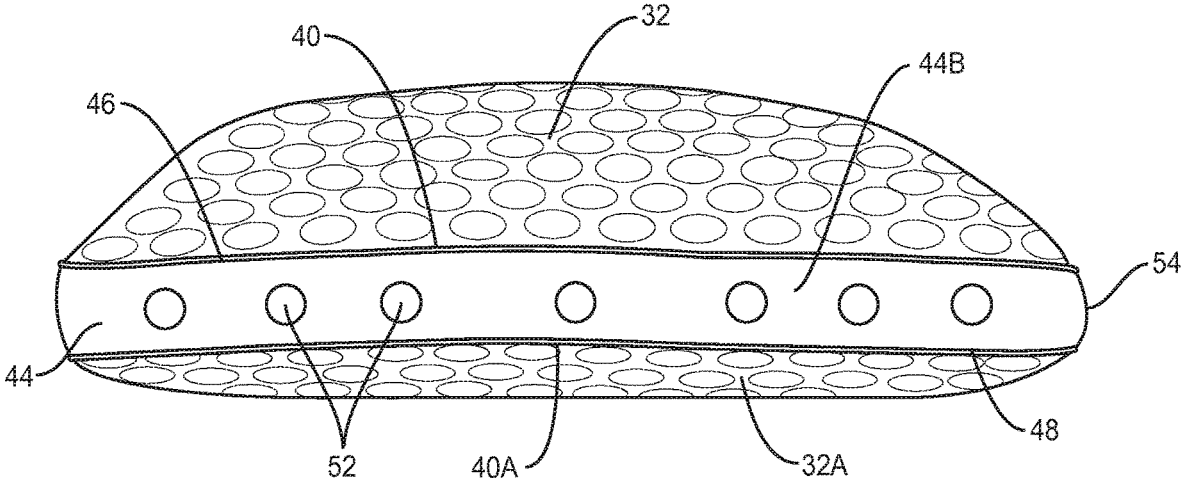
FIG. 1A is a perspective view of the pillow shown in FIG. 1.

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a pillow in accordance with the principles of the present disclosure. Alternate embodiments are also disclosed. Reference will now be made in detail to the exemplary embodiments of the present disclosure, which are illustrated in the accompanying figures. Turning to FIGS. 1-20, there are illustrated components of a pillow 30.

Pillow 30 includes a panel 32 comprising an end surface 34 and an opposite end surface 36. Surfaces 34, 36 extend between opposite side surfaces 38, 40. Surfaces 34, 36, 38 and 40 are edges of panel 32 that define a perimeter of panel 32. Pillow 30 includes a panel 32A opposite panel 32. Panel 32A comprises an end surface 34A and an opposite end surface 36A. Surfaces 34A, 36A extend between opposite side surfaces 38A, 40A. Surfaces 34A, 36A, 38A and 40A are edges of panel 32A that define a perimeter of panel 32A. In some embodiments, panels 32, 32A each have a rectangular or substantially rectangular footprint. In some embodiments, panel 32 and/or panel 32A may have various cross section configurations or footprints, such as, for example, oval, oblong, triangular, rectangular, square, polygonal, or irregular.

In some embodiments, panels 32, 32A each include a single layer of material, such as, for example, fabric. In some embodiments, panels 32, 32A each include multiple layers of material, such as, for example, fabric. In some embodiments, panels 32, 32A each comprise a moisture dispersing material. In some embodiments, panels 32, 32A each comprise a breathable material, such as, for example a breathable fabric. In some embodiments, panels 32, 32A each comprise a material selected from a group consisting of: a 100% polyester fabric, rayon, nylon, or a spandex-blend fabric. A cooling material, such as a gel, may be applied interiorly to panel 32 and/or panel 32A. The cooling material may be silicon or polyether gel formed into layers and applied shapes, as well as, formed ceramics, neoprene and other material technology for use to perform heat transfer and temperature regulation function. Depending on the nature and stability of the cooling material, the cooling material may be applied internally and/or externally to panel 32 and/or panel 32A.

Figure 4:
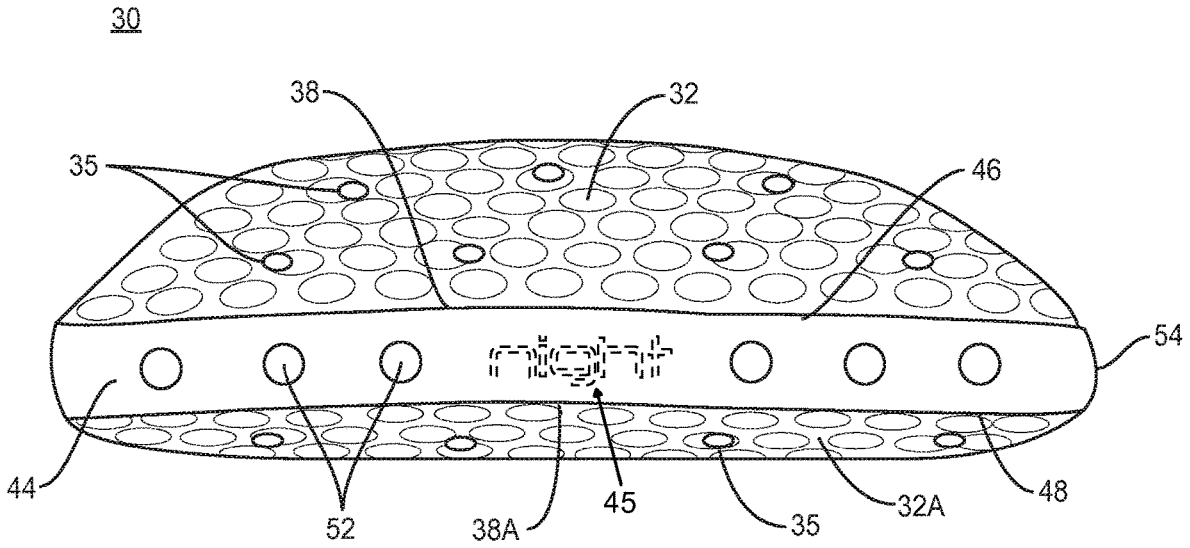
FIG. 4 is a perspective view of one embodiment of the pillow shown in FIG. 1, in accordance with the principles of the present disclosure.

In some embodiments, panels 32, 32A each comprise a porous base material and have a porosity. In some embodiments, panels 32, 32A each comprise pores that are defined by fibers or strands of the base material, such as, for example, a fabric that makes up each of panels 32, 32A. That is, the pores of panels 32, 32A are the spaces between the fibers or strands of the base material that makes up panels 32, 32A. In some embodiments, panels 32, 32A each comprise a base material having portals or apertures 35 that extend through fibers or strands of the base material, such as, for example, a fabric that makes up each of panels 32, 32A, as shown in FIG. 4. That is, apertures 35 separate the fibers or strands of the base material such that at least one of the fibers has two distinct portions that are separated by one of apertures 35. In some embodiments, apertures 35 are larger than the pores. In some embodiments, the pores have a random configuration (size, shape and/or spacing) that is determined by the arrangement of the fibers or strands of the base material and apertures 35 are formed in the base material to have a uniform configuration, such as, for example, uniform size, shape and/or spacing. In some embodiments, apertures 35 are variously shaped, such as, for example, oval, oblong, triangular, square, polygonal, irregular, uniform, non-uniform, offset, staggered, undulating, arcuate, variable and/or tapered.

Figure 3:
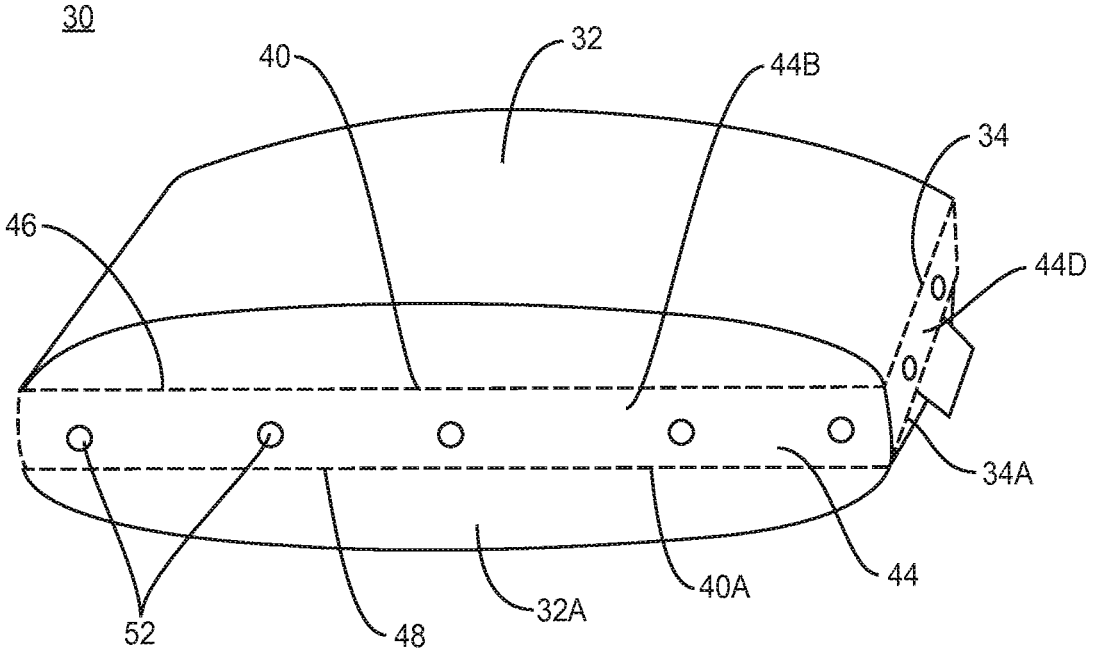
FIG. 3 is a perspective view of the pillow shown in FIG. 1.

In some embodiments, panels 32, 32A each include stitching 42 that reduces the profile of stitched portions of panels 32, 32A to create different elevations of the fabric structure, so that there are highs and lows of profile that increase air circulation in around and through outer surfaces of at least one of panels 32, 32A and between the outer surfaces of at least one of panels 32, 32A and the sleeper. In some embodiments, stitching 42 is stitched, embroidered or stenciled on at least one of panels 32, 32A. In some embodiments, stitching 42 comprises a plurality of rows each having a geometric pattern. In some embodiments, the rows alternate such that a feature of the geometric pattern in a respective row is not coaxial with the same feature of the geometric pattern of an adjacent row. In some embodiments, panels 32, 32A each include an area that is free of stitching such that the area has a smooth or even outer surface that is free of any recesses or protrusions to reduce the feel/friction of the structure against the skin of the sleeper and in order to maximize flexibility of this panel to adapt to the sleeper's body curves and conform within the larger pillow surface. In some embodiments, the areas of panels 32, 32A that are free of stitching are positioned equidistant between surfaces 34, 36, 38 and 40 and equidistant between surfaces 34A, 36A, 38A and 40A, respectively. In some embodiments, panels 32, 32A are each free of stitching 42, as shown in FIG. 3, for example. In some embodiments, stitching 42 can form one or more letters or designs. For example, stitching 42 may form a series of letters to form a word or words, such as, for example, a company name or a feature of pillow 30. Stitching 42 may also form a design or logo, such as, for example, a manufacturer logo.

Figure 2:
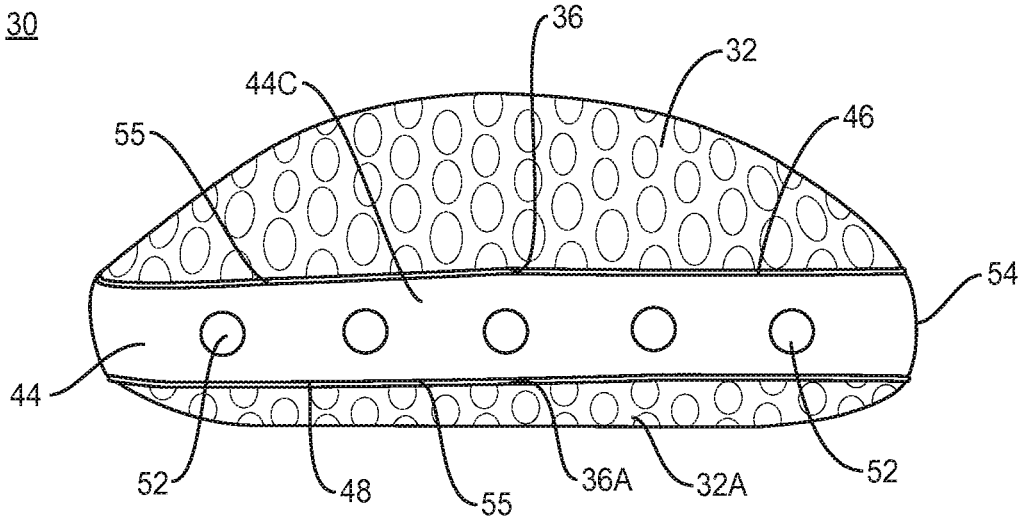
FIG. 2 is a perspective view of the pillow shown in FIG. 1.
Figure 2A:
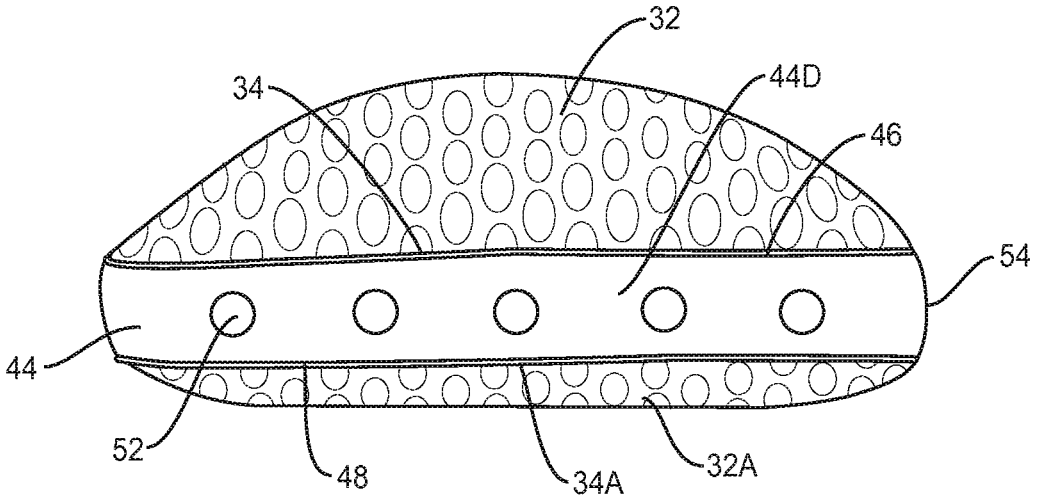
FIG. 2A is a perspective view of the pillow shown in FIG. 1.

Pillow 30 includes a gusset 44 that joins panel 32 with panel 32A. Gusset 44 comprises a surface or edge 46 and a surface or edge 48 opposite surface 46. In some embodiments, surface 46 engages surfaces 34, 36, 38, 40 and surface 48 engages surfaces 34A, 36A, 38A, 40A such that gusset 44 perimetrically bounds and joins panels 32, 32A, as shown in FIGS. 1-3, for example. That is, surface 46 continuously engages surfaces 34, 36, 38, 40 such that there are no gaps between surface 46 and surfaces 34, 36, 38, 40 and surface 48 continuously engages surfaces 34A, 36A, 38A, 40A such that there are no gaps between surface 48 and surfaces 34A, 36A, 38A, 40A. Gusset 44 separates panel 32 from panel 32A and allows air that enters an interior or cavity 62 of pillow 30 through at least one of panels 32, 32A, for example, to exit cavity 62 through gusset 44.

In some embodiments, gusset 44 is a continuous band. In some embodiments, gusset 44 comprises a longitudinal portion 44A between surfaces 38, 38A and a longitudinal portion 44B between surfaces 40, 40A. Portion 44A is positioned opposite portion 44B. In some embodiments, gusset 44 comprises a lateral portion 44C between surfaces 36, 36A and a longitudinal portion 44D between surfaces 34, 34A. Portion 44C is positioned opposite portion 44D. In some embodiments, portions 44A-D are each separate from one another and are connected to one another by stitching, for example. In some embodiments, portions 44A-D are continuous.

In some embodiments, gusset 44 includes lettering 45, as shown in FIGS. 1 and 4. In some embodiments, lettering 45 is printed, stitched, embroidered or stenciled on gusset 44. In some embodiments, gusset 44 is formed from a knit pattern and lettering 45 is part of the knit pattern. In some embodiments, gusset 44 is formed from a knit pattern having an outer surface and lettering 45 is flush with the outer surface of the knit pattern. In some embodiments, lettering 45 can form one or more letters or designs. For example, lettering 45 may be one letter or multiple letters that form a word or words, such as, for example, a model or product name of pillow, a company or manufacturer name of pillow 30, a feature of pillow 30, etc. Features of pillow 30 that may be communicated to a user by lettering 45 include, for example, the type of sleeper pillow 30 is designed for (e.g., side sleepers, back sleepers, stomach sleepers), a model or product name of pillow 30, a type of fill material or other material used in pillow 30, etc. It is envisioned that lettering 45 may include other indicia, such as, for example, a person's name or nickname, the name of a sports team or other group, a slogan or phrase, etc. Lettering 45 may also form a design or logo, such as, for example, a manufacturer logo.

In some embodiments, a reinforcing material, such as, for example, piping 55 is used to join surface 46 with surfaces 34, 36, 38, 40 and/or surface 48 with surfaces 34A, 36A, 38A, 40A. In some embodiments, piping 55 is a strip of fabric, such as, for example, folded fabric that is inserted between surfaces 34, 36, 38, 40 and surface 46 and/or between surfaces 34A, 36A, 38A, 40A and surface 48 to define edges of pillow 30. In some embodiments, piping 55 comprises a material that is different from the material gusset 44 and panels 32, 32A are made. In some embodiments, piping 55 comprises a material that is more rigid and/or less flexible than the material gusset 44 and panels 32, 32A are made. In some embodiments, piping 55 comprises a material that is non-porous.

Figure 5:
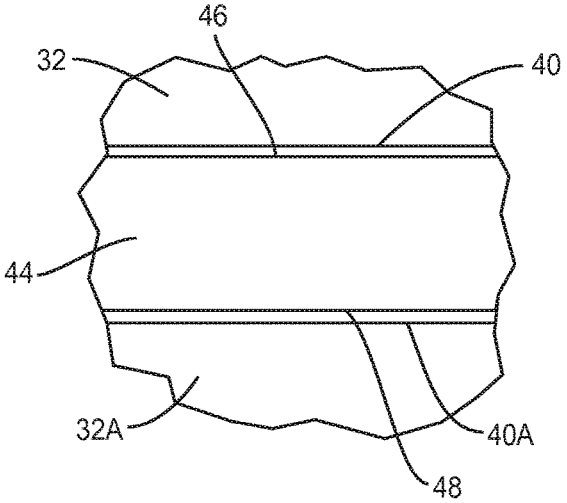
FIG. 5 is a side view of one embodiment of a component of the pillow shown in FIG. 1, in accordance with the principles of the present disclosure.

In some embodiments, gusset 44 comprises a material that is different from the material in which panels 32, 32A are made. In some embodiments, gusset 44 comprises a breathable material, such as, for example a breathable fabric. In some embodiments, gusset 44 comprises a stretchable and/or elastic material. In some embodiments, gusset 44 comprises polyester, spandex, a polyester/spandex blend, 100% polyester knit, 100% natural fabrics or natural fabrics blended with elastic fibers or waterproof fabrications. In some embodiments, as shown in FIG. 5, for example, gusset 44 is a porous sheet of material, such as, for example, fabric having a porosity that is substantially greater than (e.g., at least twice) the porosity of each of panels 32, 32A. In some embodiments, gusset 44 is porous and has a porosity that is greater than the porosity of each of panels 32, 32A. In some embodiments, the pores of gusset 44 are defined by fibers or strands of a material, such as, for example, a fabric that makes up gusset 44 to provide gusset with a porosity that is greater than the porosities of each of panels 32, 32A. That is, the pores in gusset 44 are defined by the space between fibers or strands of the material that forms gusset 44.

Figure 6:
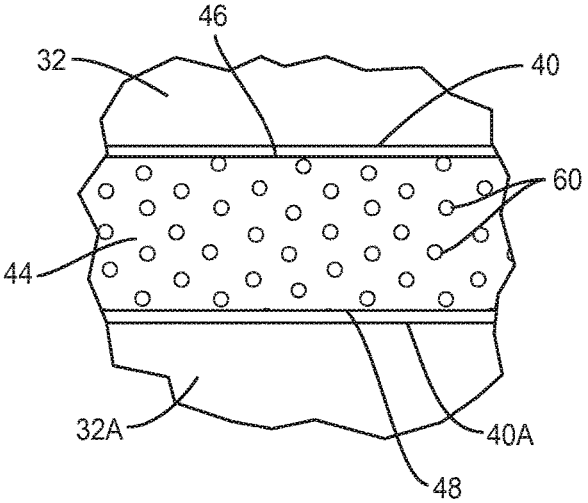
FIG. 6 is a side view of one embodiment of a component of the pillow shown in FIG. 1, in accordance with the principles of the present disclosure.

In some embodiments, gusset 44 comprises pores 60, as shown in FIG. 6, for example. In some embodiments, pores 60 are cut or otherwise formed in a material, such as, for example, a fabric that makes up gusset 44 to provide gusset with a porosity that is greater than the porosities of each of panels 32, 32A. In some embodiments, gusset 44 comprises a porous material having pores 60 cut or punched into gusset 44 during the manufacturing process to provide gusset 44 with a porosity that is greater than the porosities of each of panels 32, 32A. In some embodiments, pores 60 extend through fibers or strands that make up the material that forms gusset 44. That is, pores 60 each separate at least one of the fibers that make up the material that forms gusset 44 into two distinct portions that are separated by one of pores 60. In one embodiment, panels 32, 32A each have a porosity that is created by pores that are defined by fibers or strands of a material, such as, for example, a fabric that makes up each of panels 32, 32A and pores 60 to provide gusset 44 with a porosity that is greater than the porosities of each of panels 32, 32A. In some embodiments, pores 60 may have various cross section configurations, such as, for example, oval, oblong, triangular, rectangular, square, polygonal, irregular, uniform, non-uniform, variable, tubular and/or tapered. In some embodiments, pores 60 are distributed uniformly along gusset 44. In some embodiments, pores 60 are uniformly spaced apart from one another. In some embodiments, pores 60 are randomly dispersed along gusset 44.

In one embodiment, gusset 44 and panels 32, 32A each comprise a non-porous material having pores cut or punched therein during the manufacturing process to provide gusset 44 with a porosity that is greater than the porosities of each of panels 32, 32A. In one embodiment, gusset 44 and panels 32, 32A each comprise the same material, with gusset 44 having a porosity that is greater than the porosities of each of panels 32, 32A due to pores 60 that are cut or punched therein during the manufacturing process of gusset 44 and panels 32, 32A. In some embodiments, gusset 44 has an open cell construction. In some embodiments, the open cell construction of gusset 44 is provided by the porosity of the material of which gusset 44 is made and/or pores that are formed into the material during the manufacturing process.

Figure 7:
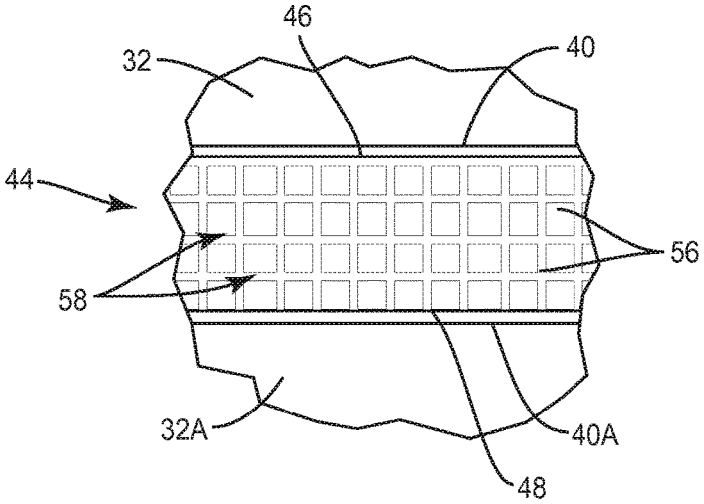
FIG. 7 is a side view of one embodiment of a component of the pillow shown in FIG. 1, in accordance with the principles of the present disclosure.

In one embodiment, shown in FIG. 7, gusset 44 comprises a plurality of interlaced or spaced apart strands 56 arranged randomly or in various patterns, such as, for example, a rectangular pattern. Strands 56 may be of various materials, including, for example, polyester, and may be elastic or inelastic. Strands 56 are arranged so that open cells 58 are defined therebetween. Strands 56 may be connected at points of intersection, such as, for example, by fusion, stitching, being tied, by a fastener or may be not connected so as to permit free movement between contacting strands 56. If connected, strands 56 may be formed of elastic material. In some embodiments, strands 56 may be disposed in multiple layers so as to define a three-dimensional structure in a direction towards interior or cavity 62.

Figure 8:
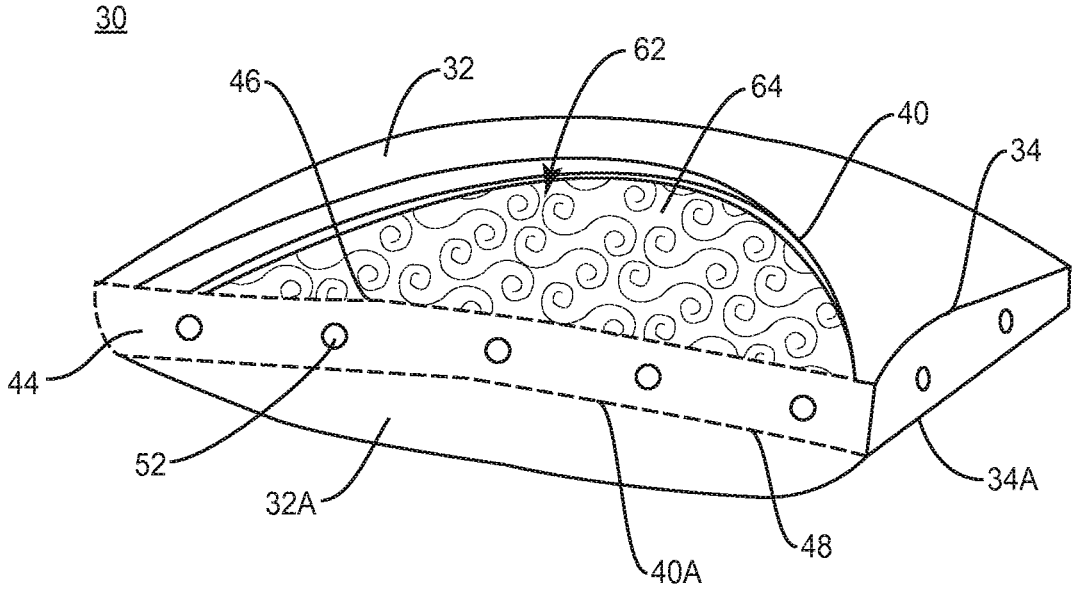
FIG. 8 is a perspective view of one embodiment of the pillow shown in FIG. 1, in accordance with the principles of the present disclosure.
Figure 9:
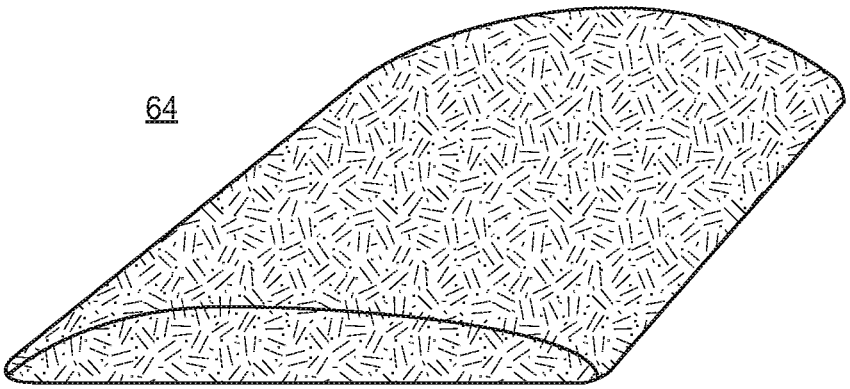
FIG. 9 is a side view of one embodiment of a component of the pillow shown in FIG. 1, in accordance with the principles of the present disclosure.

Gusset 44 and panels 32, 32A define a cover. An inner surface 50 of gusset 44 and inner surfaces of panels 32, 32A define cavity 62, as shown in FIG. 8, for example. Cavity 62 is configured for disposal of a fill material 64, as shown in FIG. 9, for example. In some embodiments, fill material 64 comprises a compliant material. In some embodiments, fill material 64 comprises a non-compliant material. In some embodiments, fill material 64 comprises polyester fiber, wool, kapok, latex, foam, memory foam, feathers, gel, memory foam and/or combinations or blends of the same. In some embodiments, fill material 64 comprises a single piece of foam, as shown in FIG. 9. In some embodiments, a top surface of fill material 64 is convexly curved between side surfaces of fill material 64 to provide a central portion of fill material 64 at a greater elevation than portions of fill material 64 either of the side surfaces of fill material 64. This configuration provides fill material 64 with an arcuate profile that imparts an outwardly bowed shape to pillow 30 when fill material 64 is positioned within cavity 62.

In some embodiments, fill material 64 has a uncompressed volume that is greater than an unexpanded volume of one of cavity 62. Due to the material(s) from which panels 32, 32A and gusset 44 are made and the relative volumes of fill material 64 and cavity 62, cavity 62 expands as fill material 64 is positioned in cavity 62. As cavity 62 expands, cavity 62 and/or pillow 30 assumes the general shape of fill material 64. Due to the material(s) from which panels 32, 32A and gusset 44 are made and the relative volumes of fill material 64 and cavity 62, cavity 62 molds to conform with the outer dimensions of fill material 64 such that pillow 30 will have approximately the same shape as fill material 64. In some embodiments, pillow 30 includes at least some air between panels 32, 32A and fill material 64 and/or between gusset 44 and fill material 64. In some embodiments, panels 32, 32A engage fill material 64 such that there is no air between panels 32, 32A and fill material 64 and gusset 44 engages fill material 64 such that there is no air between gusset 44 and fill material 64. In some embodiments, fill material 64 is porous such that air in cavity 62 becomes trapped within the pores of fill material 64. The air trapped within the pores of fill material 64 can exit pillow 30 through panels 32, 32A, gusset 44 and/or ports 52.

Figure 10:
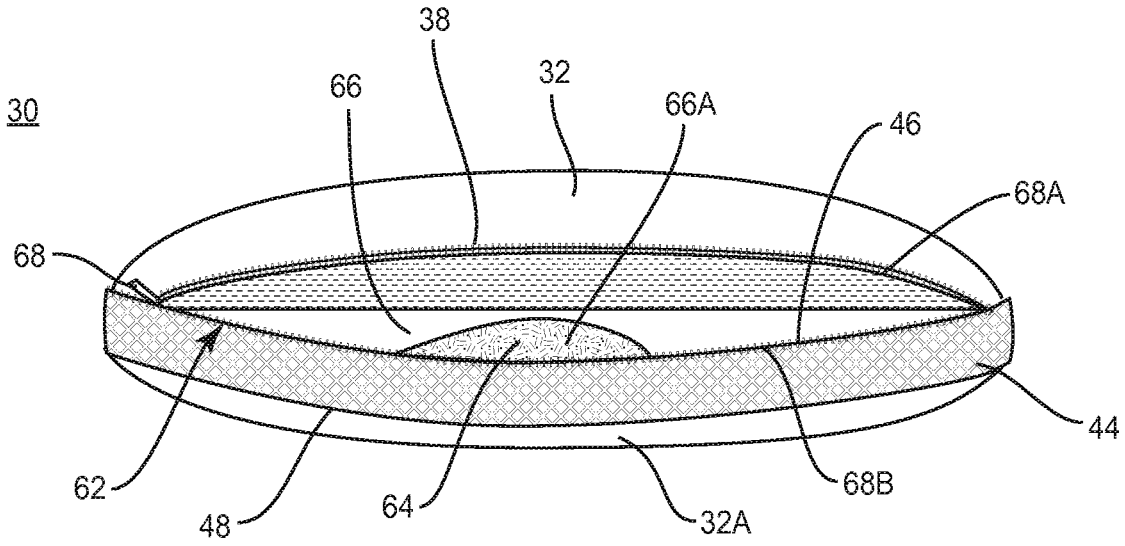
FIG. 10 is a side view of one embodiment of the pillow shown in FIG. 1, in accordance with the principles of the present disclosure.

In some embodiments, pillow 30 comprises an inner cover 66 positioned within cavity 62, as shown in FIG. 10, for example. Cover 66 comprises an inner surface defining a chamber 66A configured for disposal of fill material 64 such that fill material 64 is spaced apart from the inner surfaces of panels 32, 32A and gusset 44. That is, positioning fill material 64 within the chamber of cover 66 prevents fill material 64 from contacting panels 32, 32A or gusset 44. In some embodiments, cover 66 is a pouch. In some embodiments, cover 66 comprises a fastener, such as, for example a zipper to maintain fill material 64 within the chamber of cover 62.

In some embodiments, pillow 30 comprises a fastener, such as, for example a zipper 68 between panel 32 and gusset 44 and/or between panel 32A and gusset 44 to provide access to cavity 62. Zipper 68 includes a first row of teeth 68A and a second row of teeth 68B that interlock with teeth 68A such that zipper 68 is movable between a closed configuration in which teeth 68A interlock with teeth 68B and an open configuration in which teeth 68A are spaced apart from teeth 68B, as shown in FIG. 10, for example. In some embodiments, teeth 68A are positioned on surface 38 and teeth 68B are positioned on surface 46. In some embodiments, teeth 68A are positioned on surface 38A and teeth 68B are positioned on surface 48. In some embodiments, teeth 68A are positioned on surface 40 and teeth 68B are positioned on surface 46. In some embodiments, teeth 68A are positioned on surface 40A and teeth 68B are positioned on surface 48. In some embodiments, teeth 68A are positioned on surface 34 and teeth 68B are positioned on surface 46. In some embodiments, teeth 68A are positioned on surface 34A and teeth 68B are positioned on surface 48. In some embodiments, teeth 68A are positioned on surface 36 and teeth 68B are positioned on surface 46. In some embodiments, teeth 36A are positioned on surface 40A and teeth 68B are positioned on surface 48. Fill material 64 and/or cover 66 can be positioned within cavity 62 when zipper 68 is in the open configuration. Zipper 68 is then moved from the open position to the closed position to maintain fill material 64 and/or cover 66 within cavity 62.

Gusset 44 comprises at least one port 52 therein that extends through and between surface 50 and an outer surface 54 of gusset 44 such that ports 52 are each in communication with cavity 62 to allow air to move in and out of cavity 62 through ports 52. Ports 52 each have a porosity that is greater than that of gusset 44 such that air that enters cavity 62 can exit cavity 62 through one or more of ports 52. Likewise, ambient air may enter cavity 62 through ports 52. Ports 52 thus permit the exchange of air in and out of cavity 62. In some embodiments, ports 52 allows a greater amount of air to flow in and out of cavity 62 than is permitted with gusset 44 alone. That is, the amount of air flow in and out of cavity 62 is increased in areas of pillow 30 that include ports 52 relative to areas of pillow 30 that do not include ports 52. This configuration allows air having an increased temperature, due to heat from a user's head as the user lies upon pillow 30, for example, to move through panels 32, 32A and/or gusset such that the heated air enters cavity 62. Rather than remaining trapped within cavity 62 and increasing the temperature of pillow 30, the heated air is moved out of cavity 62 primarily through ports 52. In some embodiments, at least some residual heated air may exit cavity 62 through pores in gusset 44 and/or ports 52. This removes heated air from the sleep surface of pillow 30 (e.g. an outer surface of panel 32 or panel 32A), moves the heat air through cavity 62 and out of ports 52. Significantly, because ports 52 are positioned away from the sleep surface, the heated air will not affect the sleep surface after the heated air is vented through ports 52.

In some embodiments, gusset 44 comprises a plurality of spaced apart ports 52. In some embodiments, ports 52 are evenly or uniformly spaced apart from one another. In some embodiments, ports 52 are formed by stitching. In some embodiments, a portion of gusset 44 may be cut out to define one of ports 52. In some embodiments, ports 52 are reinforced by stitching to provide strength to gusset 44 and/or prevent gusset 44 from ripping or tearing at ports 52, for example. In some embodiments, gusset 44 includes ports 52 that are spaced apart along each of portions 44A-D. In some embodiments, at least one of portions 44A-D does not include any ports 52. In some embodiments, portions 44C, 44D include ports 52 and portions 44A, 44B do not include any ports to increase the amount of air flow through portions 44C, 44D relative to portions 44A, 44B. In some embodiments, one of portions 44C, 44D includes ports 52 and portions 44A, 44B and the other of portion 44C or portion 44D do not include any ports 52 to increase the amount of air flow through one of portions 44C or 44D relative to portions 44A, 44B and the other of portion 44C or portion 44D. In some embodiments, portions 44A, 44B include ports 52 and portions 44C, 44D do not include any ports 52 to increase the amount of air flow through portions 44A, 44B relative to portions 44C, 44D. In some embodiments, one of portions 44A, 44B includes ports 52 and portions 44C, 44D and the other of portions 44A, 44B do not include any ports 52 to increase the amount of air flow through portions one of portions 44A, 44B relative to portions 44C, 44D and the other of portions 44A, 44B.

In some embodiments, ports 52 are selectively positioned along gusset 44 to increase air flow in and out of cavity 62 at selected positions of pillow 30. For example, ports 52 may be included in each of portions 44A-D, as discussed above. However, at least one of portions 44A-D may include more ports 52 than another of portions 44A-D to provide increased air flow in and out of cavity 62 in the portion with more ports 52 relative to the remaining portions of gusset 44. That is, providing one of portions 44A-D with an increased density of ports 52 will provide increased air flow in and out of cavity 62 than the remaining portions of gusset 44.

While pillow 30 is illustrated as having a single row of ports 52 that extends parallel to surfaces 34, 36, 38, 40 or surfaces 34A, 36A, 38A, 40A, in some embodiments pillow 30 may include more than one row of ports 52 each extending parallel to surfaces 34, 36, 38, 40 or surfaces 34A, 36A, 38A, 40A, pillow 30. In some embodiments, at least one of portions 44A-D includes a single row of ports 52 that extends parallel to surfaces 34, 36, 38, 40 or surfaces 34A, 36A, 38A, 40A and at least one of portions includes more than one row of ports 52 each extending parallel to surfaces 34, 36, 38, 40 or surfaces 34A, 36A, 38A, 40A, pillow 30. Each row includes at least one port 52. This configuration thus provides one means to increase the density of ports 52 in one portion of gusset 44 relative to another portion of gusset 44. Likewise, while ports 52 are illustrated as being positioned equidistant between surfaces 34, 36, 38, 40 and surfaces 34A, 36A, 38A, 40A, in some embodiments, at least one of ports 52 is positioned closer to surfaces 34, 36, 38, 40 than surfaces 34A, 36A, 38A, 40A. In some embodiments, at least one of ports 52 is positioned closer to surfaces 34A, 36A, 38A, 40A than surfaces 34, 36, 38, 40. In some embodiments, at least one of ports 52 is positioned closer to surfaces 34, 36, 38, 40 than surfaces 34A, 36A, 38A, 40A and at least one of ports 52 is positioned closer to surfaces 34A, 36A, 38A, 40A than surfaces 34, 36, 38, 40.

Figure 4A:
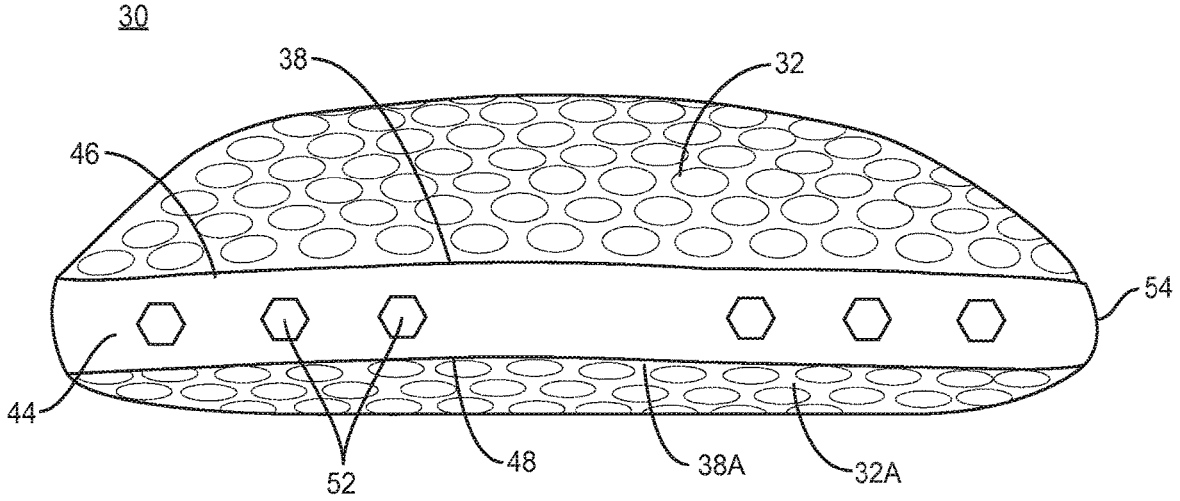
FIG. 4A is a perspective view of one embodiment of the pillow shown in FIG. 1, in accordance with the principles of the present disclosure.
Figure 4B:
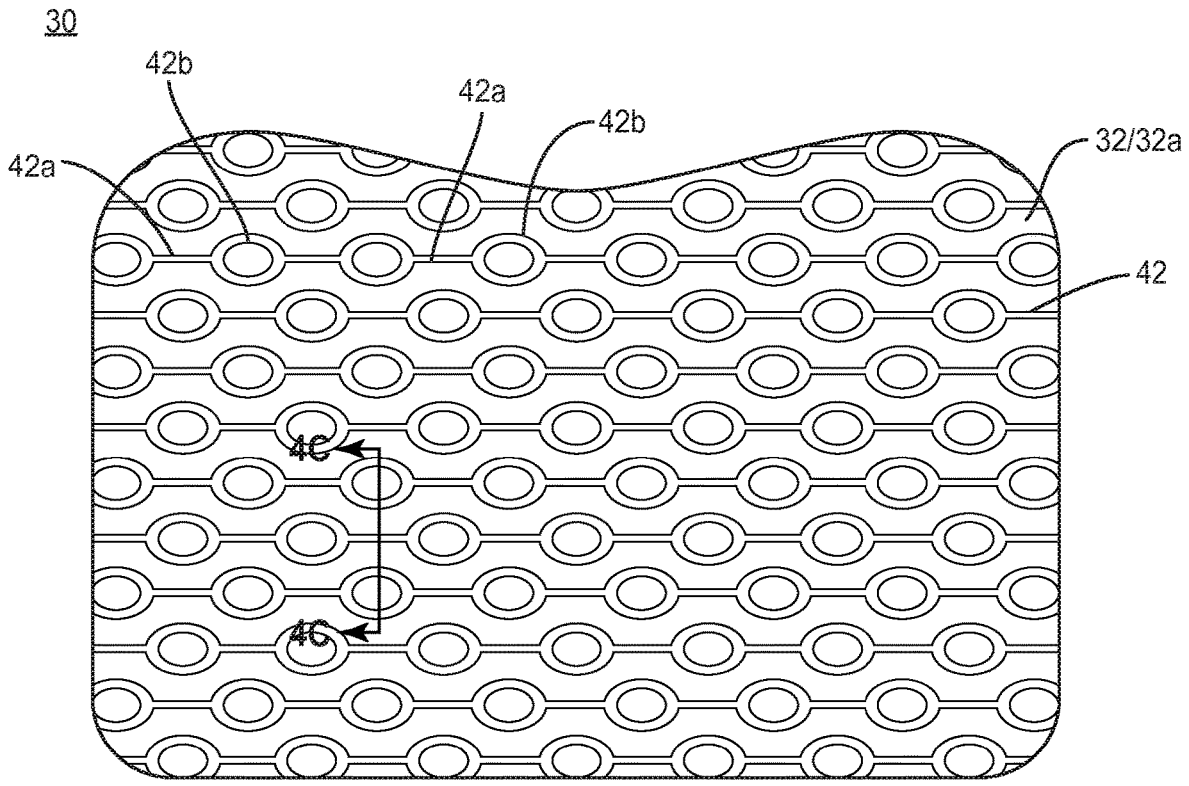
FIG. 4B is a perspective view of one embodiment of the pillow shown in FIG. 1, in accordance with the principles of the present disclosure.
Figure 4C:
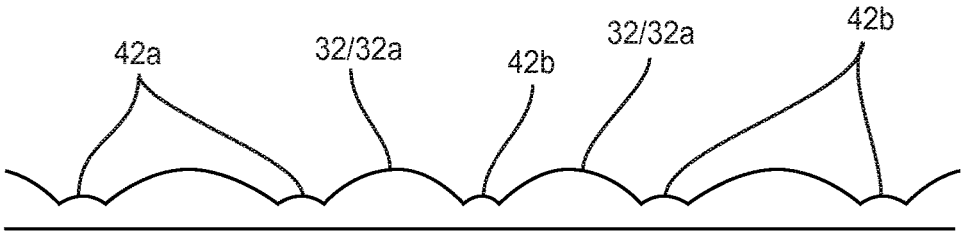
FIG. 4C is a close up, detailed view of one embodiment of the pillow shown in FIG. 1, taken along lines 4C in FIG. 4B.

Ports 52 each have a porosity that is greater than the porosity of gusset 44, as discussed above. In some embodiments, ports 52 each have an open cell construction that is greater than that of gusset 44 such that a greater amount of air can pass through each of ports 52 than through a portion of gusset 44 having an identical size of one of ports 52. In some embodiments, ports 52 are holes in gusset 44 that are defined by the absence of material to provide ports 52 with a porosity that is greater than the porosity of gusset 44. In some embodiments, ports 52 each comprise a mesh material, such as, for example, a metal or non-metal mesh material, such as, for example, plastic or elastic to provide ports 52 with a porosity that is greater than the porosity of gusset 44. In some embodiments, ports 52 each comprise a breathable material, such as, for example, a breathable fabric to provide ports 52 with a porosity that is greater than the porosity of gusset 44. In some embodiments, ports 52 each have an arcuate configuration, such as, for example, the circular configuration shown in FIGS. 1-3. In some embodiments, ports 52 each have a polygonal configuration, such as, for example, the hexagonal configuration shown in FIG. 4A. In some embodiments, ports 52 may have various cross section configurations, such as, for example, oval, oblong, triangular, rectangular, square, polygonal, irregular, uniform, non-uniform, variable, tubular and/or tapered.

Figure 11:
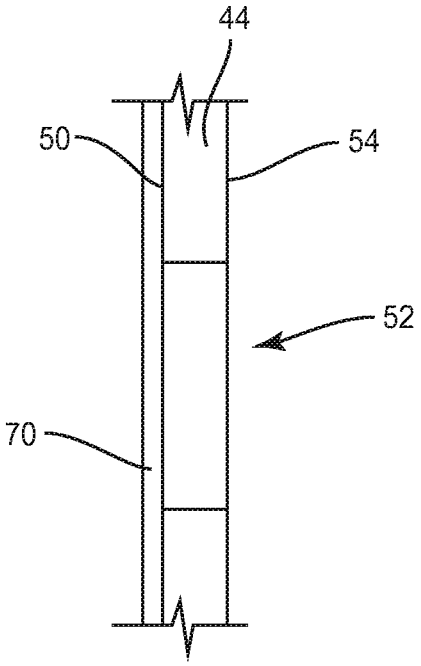
FIG. 11 is a side, cross-sectional view of components of one embodiment of the pillow shown in FIG. 1, in accordance with the principles of the present disclosure.

In some embodiments, gusset 44 includes a filter 70 that engages surface 50 and overlaps at least a portion of at least one of ports 52, as shown in FIG. 11, for example. Filter 70 comprises a porous and/or mesh material that is configured to trap dust, pollen, mold, bacteria and contaminants therein to prevent such dust, pollen, mold, bacteria and contaminants from entering cavity 62 through ports 52. In some embodiments, pillow 30 comprises a plurality of filters 70 that each completely overlap at least one of ports 52. In some embodiments, filter 70 is a single sheet or piece of material that completely overlaps at least one of ports 52. In some embodiments, filter 70 has a porosity that is greater than that of gusset 44. In some embodiments, filter 70 has a porosity that is greater than that of ports 52, yet when combined with ports 52, ports 52 each have a porosity with filter 70 completely overlapping each of ports 52 that is greater than that of gusset 44. In some embodiments, filter 70 has a porosity that is less than that of ports 52, yet when combined with ports 52, ports 52 each have a porosity with filter 70 completely overlapping each of ports 52 that is greater than that of gusset 44.

Figure 12:
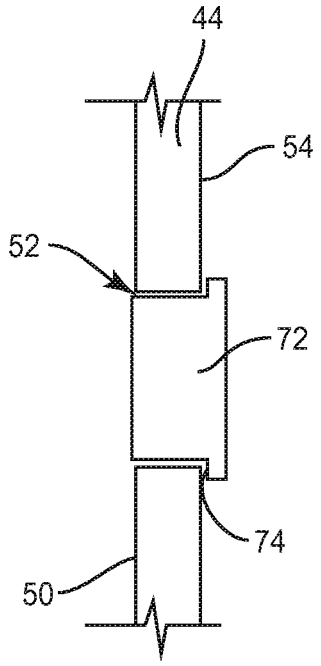
FIG. 12 is a side, cross-sectional view of components of one embodiment of the pillow shown in FIG. 1, in accordance with the principles of the present disclosure.

In some embodiments, at least one of ports 52 includes a removable cap 72 positioned therein to block or substantially block air flow through ports 52, as shown in FIG. 12, for example. That is, caps 72 each prevent ambient air from moving into cavity 62 through ports 52 and/or prevent air within cavity 62 from escaping cavity 62 through ports 52. In some embodiments, caps 72 comprise a solid, non-porous material that does not permit the passage of air therethrough. In one embodiment, caps 72 each include a lip 74 that engages surface 54 when caps 72 are positioned in ports 52 to prevent caps 72 from falling through ports 52 and into cavity 62. In some embodiments, caps 72 can be variously connected with gusset 44, such as, for example, frictional engagement, threaded engagement, mutual grooves, screws, adhesive, nails, barbs and/or raised element. In some embodiments, each of ports 52 are initially provided with a cap 72 therein such that a user can selectively remove caps 72 to adjust the amount of airflow through ports 52 and/or gusset. For example, if a user desires more airflow out of ends of pillow 30 than on sides of pillow 30, he or she may leave caps 72 within ports 52 in portions 44A, 44B and remove at least one of caps 72 from ports 52 in portions 44C, 44D. Likewise, if a user desires more airflow out of sides of pillow 30 than on ends of pillow 30, he or she may leave caps 72 within ports 52 in portions 44C, 44*d* and remove at least one of caps 72 from ports 52 in portions 44A, 44B. In some embodiments, caps 72 form a seal with gusset that is air tight to prevent air flow through ports 52. In some embodiments, caps 72 allow limited air flow through ports 52 when caps 72 are positioned in ports 52. That is, the amount of air flow through ports 52 is reduced when caps 72 are positioned in ports 52, relative to when caps 72 are removed from ports 52.

Figure 12A:
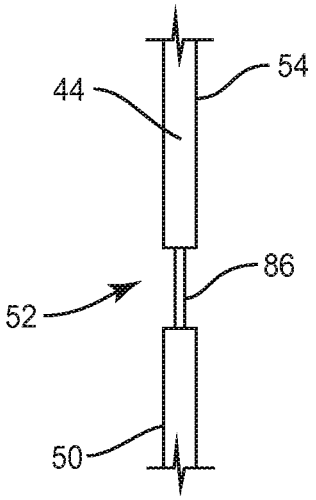
FIG. 12A is a side, cross-sectional view of components of one embodiment of the pillow shown in FIG. 1, in accordance with the principles of the present disclosure.
Figure 12B:
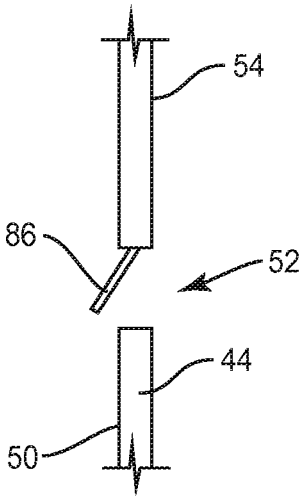
FIG. 12B is a side, cross-sectional view the pillow shown in FIG. 12A.

In one embodiments, shown in FIGS. 12A and 12B, at least one of ports 52 includes a movable flap 86 that prevents air from entering cavity 62 through port 52 and prevents air within cavity 62 from exiting cavity 62 through port 52. In some embodiments, flap 86 is a section of material, such as, for example, rubber or silicone that forms a seal with an inner surface of port 52 that is air tight or water tight. Flap 86 is movable between a closed position, shown in FIG. 12A, in which flap 86 prevents air from entering cavity 62 through port 52 and prevents air within cavity 62 from exiting cavity 62 through port 52 and an open configuration, shown in FIG. 12B, in which flap 86 allows air to enter cavity 62 through port 52 and allows air within cavity 62 to exit cavity 62 through port 52. In some embodiments, flap 86 is biased to the closed configuration. In some embodiments, flap 86 is moved from the closed configuration to the open configuration by inserting an object, such as, for example, a user's finger into port 52 to apply a force upon flap 86. In some embodiments, flap 86 remains in the open configuration after being moved to the open configuration. In some embodiments, the force applied to flap 86 must be maintained to keep flap 86 in the open configuration.

Figure 13:
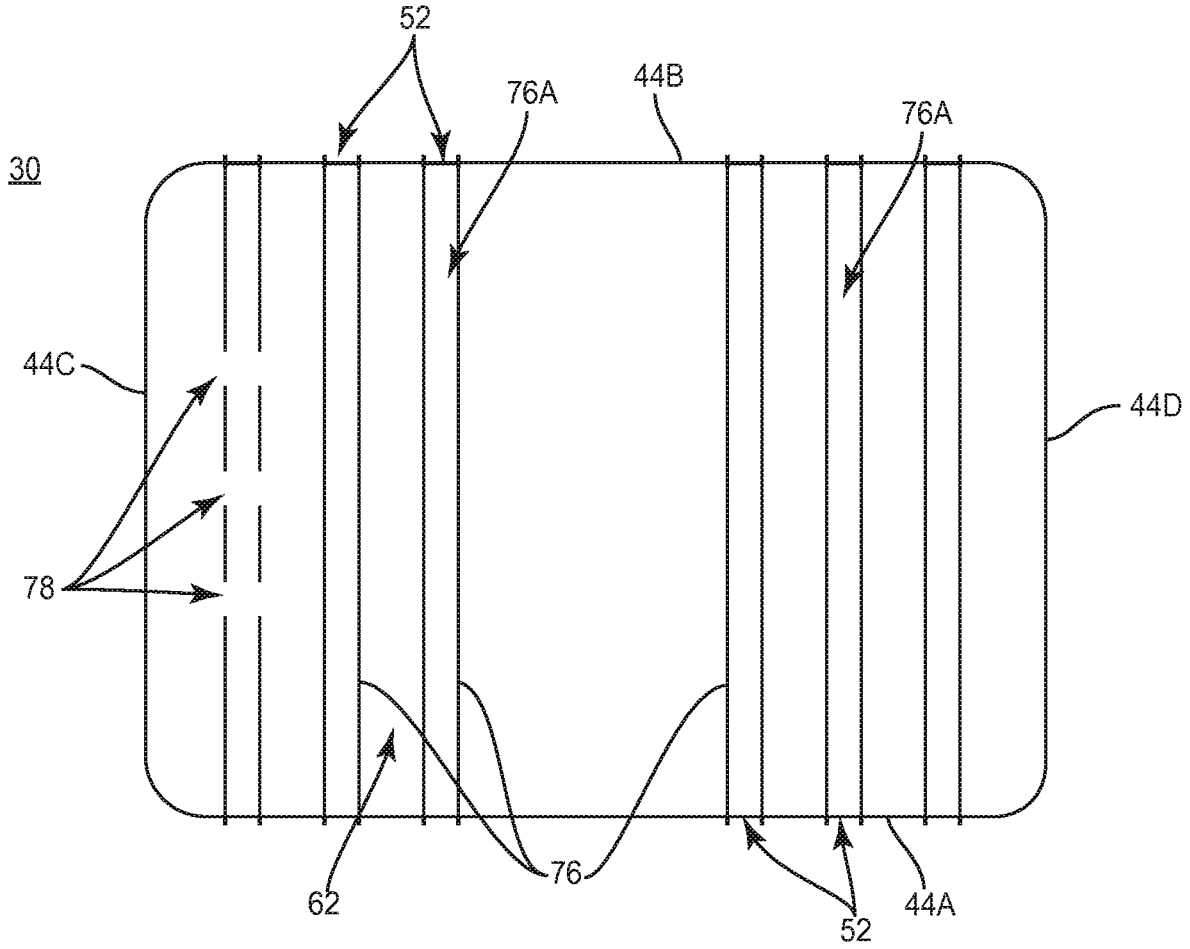
FIG. 13 is a top, cross sectional view of one embodiment the pillow shown in FIG. 1, in accordance with the principles of the present disclosure.

In some embodiments, pillow 30 includes connecting elements 76 that extend between and connect at least one of ports 52 in portion 44A with at least one of ports 52 in portion 44B, as shown in FIG. 13, for example. That is, elements 76 are conduits or tubes that connect one of ports 52 with an opposite port 52. Elements 76 each include an inner surface defining a channel 76A. Opposite ends of each element 76 includes openings that are in communication with channel 76A and a respective one of ports 52. In some embodiments, elements 76 include at least one aperture or opening 78 extending through inner and outer surfaces of elements 76 that are in communication with cavity 62. As such, ambient air enters elements 76 through ports 52 and exits elements 76 via openings 78 to disperse the ambient air within chamber 62. Likewise, air within chamber 62 enters elements 76 through openings 78 and then exits pillow through ports 52. Elements 76 thus act to direct air flow in and out of ports 52. In some embodiments, elements 76 do not include any openings 78 and are porous to allow air to enter and exit elements 76 to direct air flow in and out of ports 52 in the manner discussed above. In some embodiments, elements 76 and/or openings 78 may have various cross section configurations, such as, for example, oval, oblong, triangular, rectangular, square, polygonal, irregular, uniform, non-uniform, variable, tubular and/or tapered. In some embodiments, openings 78 may be disposed at alternate orientations, relative to channels 76A, such as, for example, transverse, perpendicular and/or other angular orientations such as acute or obtuse, co-axial and/or may be offset or staggered.

Figure 14:
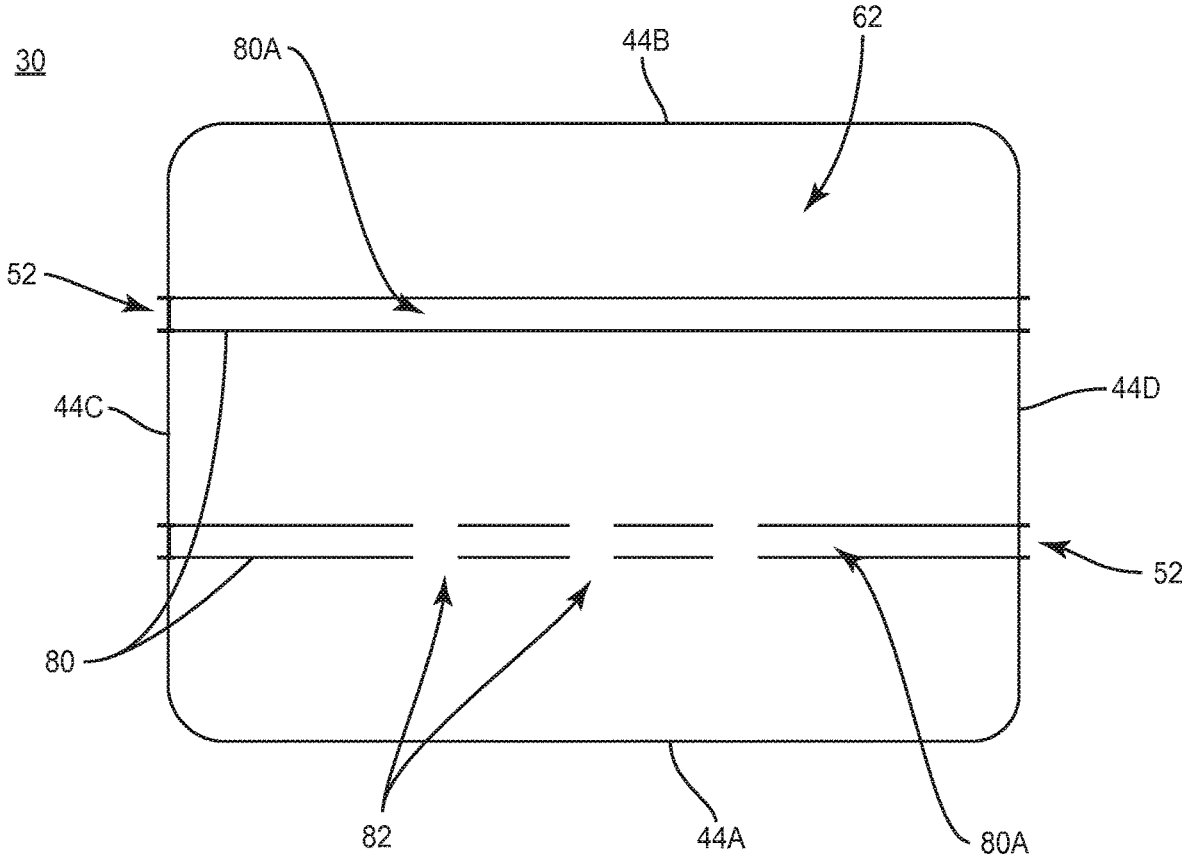
FIG. 14 is a top, cross sectional view of the pillow shown in FIG. 13.

In some embodiments, pillow 30 includes connecting elements 80 that extend between and connect at least one of ports 52 in portion 44C with at least one of ports 52 in portion 44C, as shown in FIG. 14, for example. That is, elements 80 are conduits or tubes that connect one of ports 52 with an opposite port 52. Elements 80 each include an inner surface defining a channel 80A. Opposite ends of each element 80 includes openings that are in communication with channel 80A and a respective one of ports 52. In some embodiments, elements 80 include at least one aperture or opening 82 extending through inner and outer surfaces of elements 80 that are in communication with cavity 62. As such, ambient air enters elements 80 through ports 52 and exits elements 80 via openings 82 to disperse the ambient air within chamber 62. Likewise, air within chamber 62 enters elements 80 through openings 82 and then exits pillow through ports 52. Elements 80 thus act to direct air flow in and out of ports 52. In some embodiments, elements 80 do not include any openings and are porous to allow air to enter and exit elements 80 to direct air flow in and out of ports 52 in the manner discussed above. In some embodiments, elements 80 and/or openings 82 may have various cross section configurations, such as, for example, oval, oblong, triangular, rectangular, square, polygonal, irregular, uniform, non-uniform, variable, tubular and/or tapered. In some embodiments, elements 76 extend perpendicular to elements 80. In some embodiments, elements 76 may be disposed at alternate orientations, relative to elements 80, such as, for example, transverse, perpendicular and/or other angular orientations such as acute or obtuse, co-axial and/or may be offset or staggered. In some embodiments, openings 82 may be disposed at alternate orientations, relative to channels 80A, such as, for example, transverse, perpendicular and/or other angular orientations such as acute or obtuse, co-axial and/or may be offset or staggered.

In some embodiments, elements 76 connect ports 52 that are positioned closer to surfaces 34, 36, 38, 40 than surfaces 34A, 36A, 38A, 40A and elements 80 connect ports 52 that are positioned closer to surfaces 34A, 36A, 38A, 40A than surfaces 34, 36, 38, 40 such that elements 76 do not cut through elements 80, and vice versa. In some embodiments, elements 76 connect ports 52 that are positioned closer to surfaces 34A, 36A, 38A, 40A than surfaces 34, 36, 38, 40 and elements 80 connect ports 52 that are positioned closer to surfaces 34, 36, 38, 40 than surfaces 34A, 36A, 38A, 40A such that elements 76 do not cut through elements 80, and vice versa.

Figure 15:
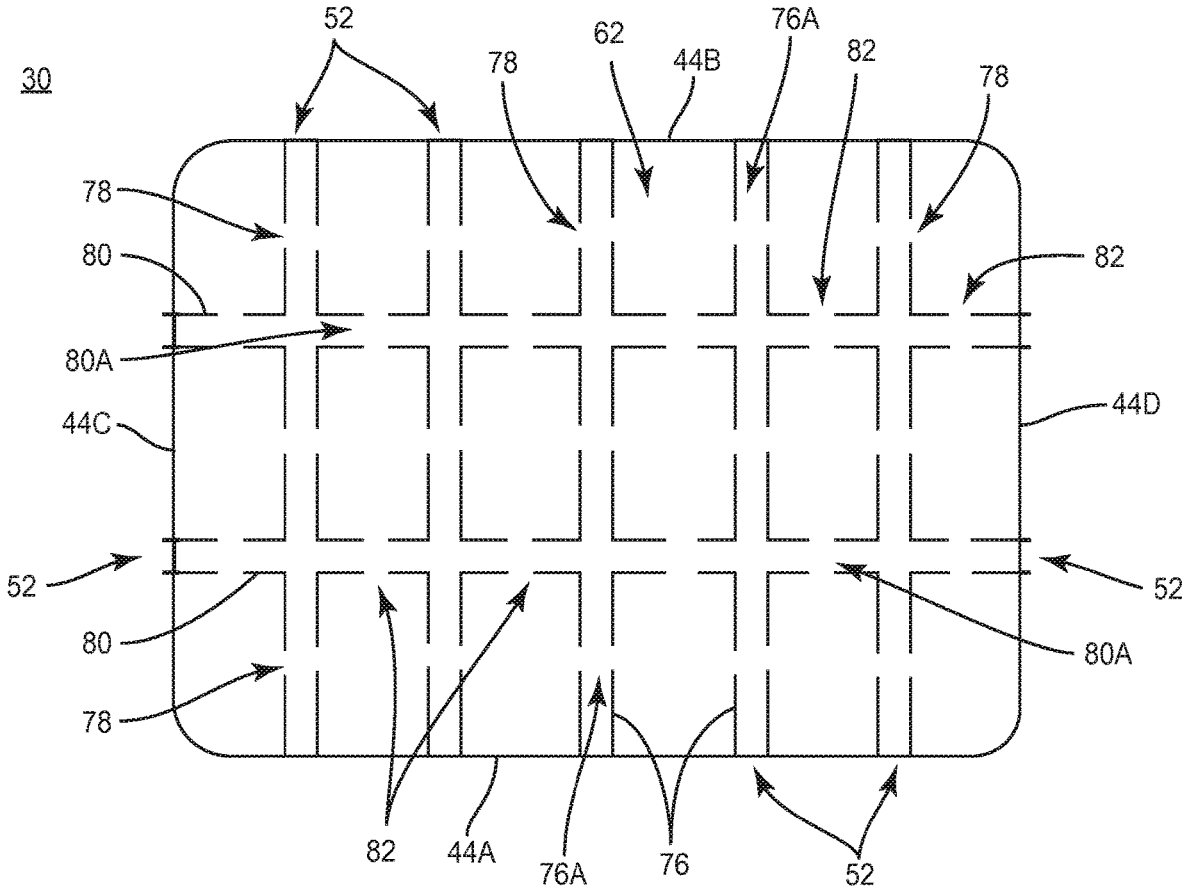
FIG. 15 is a top, cross sectional view of one embodiment the pillow shown in FIG. 1, in accordance with the principles of the present disclosure.

In some embodiments, elements 76 connect ports 52 that are positioned equidistant between surfaces 34, 36, 38, 40 and surfaces 34A, 36A, 38A, 40A and elements 80 connect ports 52 that are positioned equidistant between surfaces 34A, 36A, 38A, 40A and surfaces 34, 36, 38, 40 such that elements 76 intersect or cut through elements 80, and vice versa, as shown in FIG. 15, for example. Each of elements 76 are in communication with the other elements 76. Each of elements 80 are in communication with the other elements 80. Elements 76 are in communication with elements 80, and vice versa such that channels 76A are in communication with channels 80A. This configuration provides a network of connecting elements that are in communication with ports 52 to provide air flow in and out of cavity 62 through ports 52.

Figure 16:
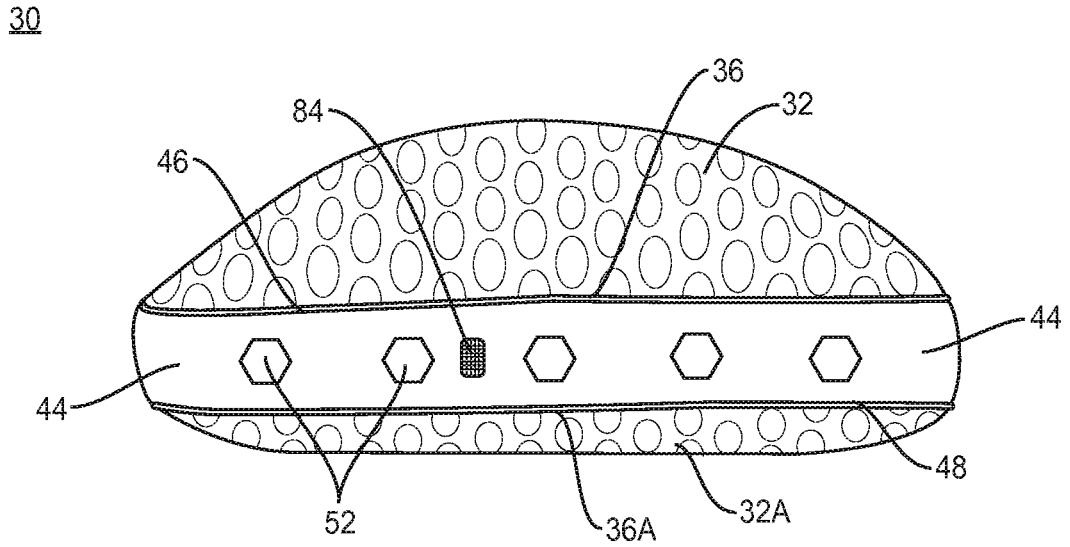
FIG. 16 is a side view of components of one embodiment of the pillow shown in FIG. 1, in accordance with the principles of the present disclosure.

In addition to ports 52, gusset 44 may include at least one scupper 84 positioned therein, as shown in FIG. 16, for example. In some embodiments, scupper 84 allows air to move into cavity 62 and prevents air from exiting cavity 62. In some embodiments, scupper 84 allows air to exit cavity 62 and prevents air from moving into cavity 62. In some embodiments, pillow 30 includes at least one scupper 84 that allows air to move into cavity 62 and prevents air from exiting cavity 62 and at least one scupper 84 that allows air to exit cavity 62 and prevents air from moving into cavity 62. Scuppers 84 may be positioned at any portion along gusset 44.

In some embodiments, gusset 44 surrounds only a portion of panel 32 and/or panel 32A. For example, in one embodiment, shown in FIG. 17, surface 38 engages surface 38A, surface 40 engages surface 40, surface 34 engages surface 34A and gusset 44 is positioned between surface 36 and surface 36A. In one embodiment, shown in FIG. 18, surface 38 engages surface 38A, surface 40 engages surface 40, surface 36 engages surface 36A and gusset 44 is positioned between surface 34 and surface 34A. These configurations position gusset 44 on one end of pillow 30 to provide increased air flow in and out of cavity 62 through the end of pillow 30 that includes gusset 44.

Figure 17:
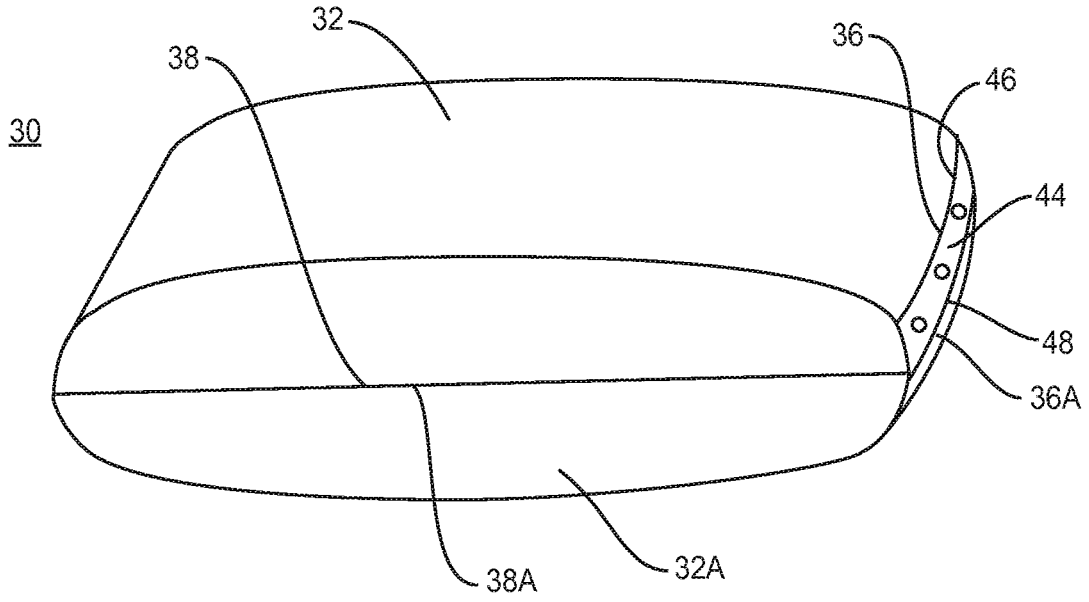
FIG. 17 is a perspective view of one embodiment of the pillow shown in FIG. 1, in accordance with the principles of the present disclosure.
Figure 18:
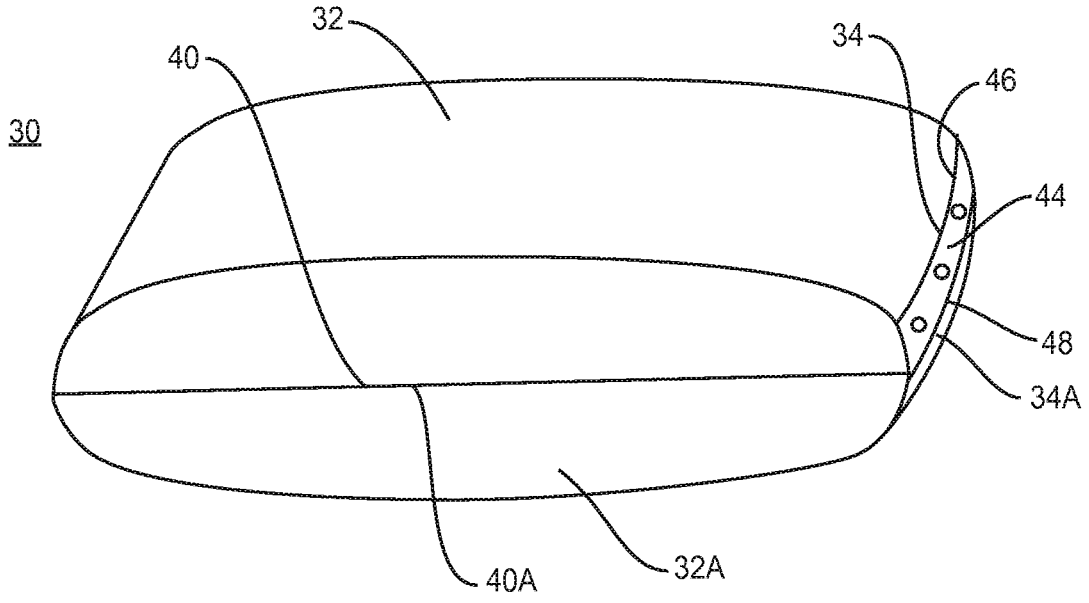
FIG. 18 is a perspective view of the pillow shown in FIG. 17.

In one embodiment, shown in FIGS. 17 and 18, surface 38 engages surface 38A, surface 40 engages surface 40A and gusset 44 comprises a first portion positioned between surface 34 and surface 34A and a second portion positioned between surface 36 and surface 36A. The first portion of gusset 44 is spaced apart from the second portion of gusset 44. This configuration positions gusset 44 on opposite ends of pillow 30 to provide increased air flow in and out of cavity 62 through the opposite ends of pillow 30.

Figure 19:
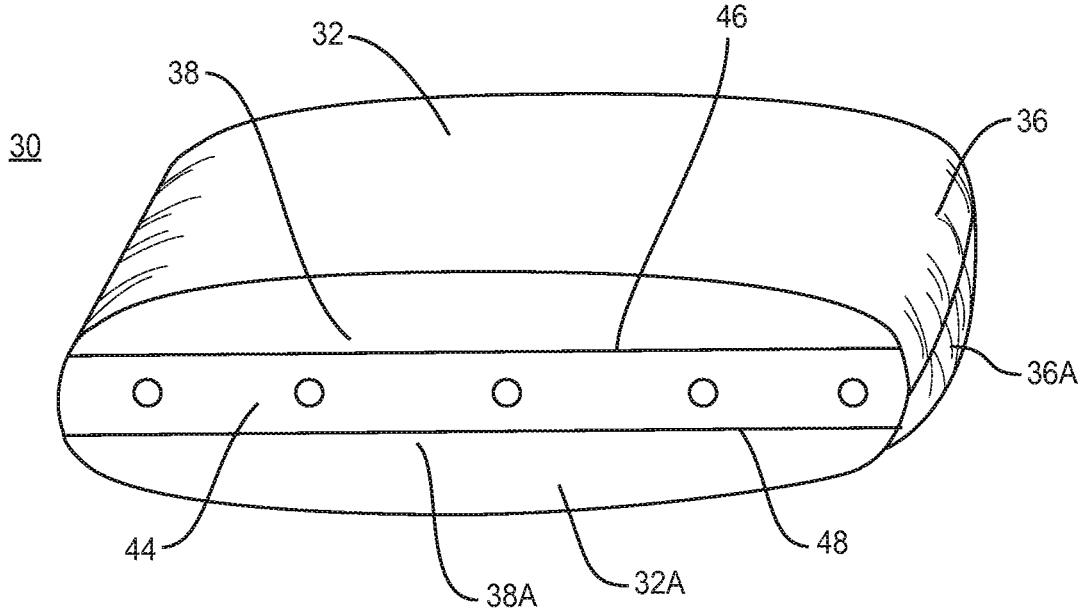
FIG. 19 is a perspective view of one embodiment of the pillow shown in FIG. 1, in accordance with the principles of the present disclosure.

In one embodiment, shown in FIG. 19, surface 40 engages surface 40A, surface 34 engages surface 34A, surface 36 engages surface 36A and gusset 44 is positioned between surface 38 and surface 38A. In one embodiment, shown in FIG. 20, surface 38 engages surface 38A, surface 34 engages surface 34A, surface 36 engages surface 36A and gusset 44 is positioned between surface 40 and surface 40A. These configurations position gusset 44 on one side of pillow 30 to provide increased air flow in and out of cavity 62 through the side of pillow 30 that includes gusset 44.

Figure 20:
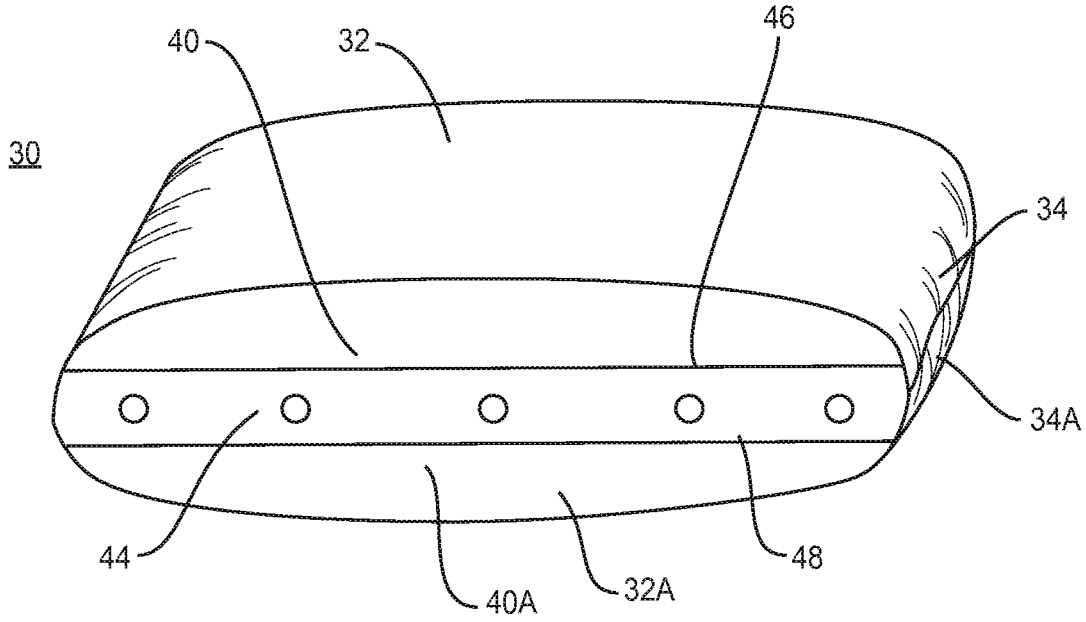
FIG. 20 is a perspective view of the pillow shown in FIG. 19.

In one embodiment, shown in FIGS. 19 and 20, surface 34 engages surface 34A, surface 36 engages surface 36A and gusset 44 comprises a first portion positioned between surface 38 and surface 38A and a second portion positioned between surface 40 and surface 40A. The first portion of gusset 44 is spaced apart from the second portion of gusset 44. This configuration positions gusset 44 on opposite sides of pillow 30 to provide increased air flow in and out of cavity 62 through the opposite sides of pillow 30.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A pillow consisting of:

a first panel;

a second panel, the panels each having opposite first and second ends and opposite third and fourth ends each extending from the first end to the second end;

a gusset positioned between the first ends, between the second ends, between the third ends and between the fourth ends, the gusset comprising a single row of ports, the ports each extending through a thickness of the gusset, the ports being positioned between the first ends, between the second ends, between the third ends and between the fourth ends, the first panel, the second panel and the gusset defining a cover; and a fill material disposed within the cover, the fill material consisting of a foam material, wherein the gusset is formed from an open cell construction and comprises a plurality of colinear portions, a first colinear portion having a first number of ports and a second colinear portion that is not colinear with the first colinear portion having a second number of ports that is less than the first number of ports, the second number of ports being greater than zero, the open cell construction being formed by spaced apart strands that are not connected at points of intersection to permit free movement between contacting strands, and wherein the pillow is configured to have air enter the cover at least through the first and second panels and have the air exit the cover through the ports.

2. A pillow as recited in claim 1, wherein the first and second panels each have a porosity that is less than a porosity of the gusset.

3. A pillow as recited in claim 1, wherein the ports are each covered by a porous fabric that is coupled to the gusset.

4. A pillow as recited in claim 1, wherein the ports are each covered by a mesh material that is coupled to the gusset.

5. A pillow as recited in claim 1, wherein the ports are spaced apart from one another, each of the ports having a circular configuration.

6. A pillow as recited in claim 1, wherein the ports are spaced apart from one another, each of the ports having a polygonal configuration.

7. A pillow as recited in claim 1, wherein the gusset is formed from a knit pattern and includes lettering that is part of the knit pattern.

8. A pillow as recited in claim 1, wherein:

a first end of the gusset engages the fourth end of the first panel; and a second end of the gusset opposite the first end engages the fourth end of the second panel.

9. A pillow as recited in claim 1, wherein the strands are disposed in multiple layers so as to define a three dimensional structure in a direction toward the fill material.

10. A pillow as recited in claim 1, wherein the strands are formed from an elastic material.

11. A pillow as recited in claim 1, wherein:

the first and second panels each comprise a base material having a porosity that is less than a porosity of the gusset; and the first and second panels each comprise a portal having a porosity that is different than the porosity of the gusset.

12. A pillow as recited in claim 11, wherein the porosity of the portals is greater than the porosity of the gusset.

13. A pillow as recited in claim 11, wherein the porosity of the portals is less than the porosity of the gusset.

14. A pillow as recited in claim 1, wherein the pillow comprises a filter material that is coupled to the gusset and extends across each of the ports.

15. A pillow as recited in claim 1, wherein at least one of the ports comprises a valve having opposite first and second ends that are each positioned between inner and outer surfaces of the gusset.

16. A pillow as recited in claim 15, wherein the valve is configured to allow air to move out of the chamber and prevents air from moving into the chamber.

17. A pillow as recited in claim 15, wherein the valve is configured to allow air to move into the chamber and prevents air from moving out of the chamber.

18. A pillow as recited in claim 1, wherein the fill material is a single piece of foam.

19. A pillow as recited in claim 18, wherein a top surface of the single piece of foam is convexly curved between side surfaces of the single piece of foam to provide a central portion of the single piece of foam at a greater elevation than portions of the single piece of foam at either of the side surfaces of the single piece of foam.

20. A pillow as recited in claim 1, wherein the fill material defines a shape of the pillow.

21. A pillow as recited in claim 1, wherein the first ends and the second ends each include a first length and the third ends and the fourth ends each have a second length that is greater than the first length.

22. A pillow as recited in claim 1, wherein the first ends and the second ends each include a first length and the third ends and the fourth ends each have a second length that is less than the first length.

23. A pillow as recited in claim 1, wherein at least one of the panels comprises a plurality of strands and a plurality of spaced apart portals that each extend through the strands of the panels such that at least one of the strands of the panels has two distinct portions that are separated by one of the portals.

24. A pillow consisting of:

a first panel;

a second panel opposite the first panel, the panels each having opposite first and second ends and opposite third and fourth ends that each extend between the first end and the second end;

a gusset positioned between the first ends, between the second ends, between the third ends and between the fourth ends, the gusset comprising a single row of ports, the ports each extending through a thickness of the gusset, the ports being positioned between the first ends, between the second ends, between the third ends and between the fourth ends, the first panel, the second panel and the gusset defining a cover; and an inner cover positioned within the cover, the inner cover defining a chamber, the chamber being filled with a fill material such that the fill material is spaced apart from the gusset by the inner cover, the fill material consisting of a foam material, wherein the gusset is formed from an open cell construction and comprises a plurality of colinear portions, a first colinear portion having a first number of ports and a second colinear portion that is not colinear with the first colinear portion having a second number of ports that is less than the first number of ports, the second number of ports being greater than zero, the open cell construction being formed by spaced apart strands that are not connected at points of intersection to permit free movement between contacting strands, wherein an interface between the first panel and the gusset comprises a fastener configured to open to provide access to the inner cover, and wherein the pillow is configured to have air enter the cover through the first and second panels and have the air exit the cover through the ports.

25. A pillow as recited in claim 24, wherein the gusset is formed of an open cell construction, the open cell construction is formed by strands defining a mesh configuration, the strands comprising polyester and being connected at points of intersection of the strands.

26. A pillow consisting of:

a first panel;

a second panel opposite the first panel, the panels each having opposite first and second ends and opposite third and fourth ends that each extend from the first end to the second end;

a gusset positioned between the first ends, between the second ends, between the third ends and between the fourth ends, the gusset comprising an open cell construction, the gusset comprising only a single row of ports, the ports each extending through a thickness of the gusset, the ports being positioned between the first ends, between the second ends, between the third ends and between the fourth ends, the pillow comprising a mesh material coupled to the gusset such that the mesh material covers each of the ports, the ports being spaced apart from one another, the first panel, the second panel and the gusset defining a cover defining a chamber; and an inner cover positioned within the chamber, the inner cover being filled with a fill material such that the fill material is spaced apart from the panels and the gusset, the fill material consisting of a foam material, wherein the gusset comprises a plurality of colinear portions, a first colinear portion having a first number of ports and a second colinear portion that is not colinear with the first colinear portion having a second number of ports that is less than the first number of ports, the second number of ports being greater than zero, wherein an interface between the first panel and the gusset comprises a zipper configured to provide access to the chamber, wherein the open cell construction is formed by spaced apart strands that are not connected at points of intersection to permit free movement between contacting strands, and wherein the pillow is configured to have air enter the cover through the first and second panels and have the air exit the cover through the ports.

27. A pillow consisting of:

a first panel;

a second panel opposite the first panel, the first and second panels each comprising a base material having a first porosity, the panels each having opposite first and second ends and opposite third and fourth ends that each extend from the first end to the second end;

a gusset positioned between the first ends, between the second ends, between the third ends and between the fourth ends, the gusset comprising an open cell construction having a second porosity that is greater than the first porosity, the gusset comprising only a single of ports, the ports each extending through a thickness of the gusset, the ports being positioned between the first ends, between the second ends, between the third ends and between the fourth ends, the pillow comprising a mesh material coupled to the gusset such that the mesh material covers each of the ports, the ports being spaced apart from one another, the first panel, the second panel and the gusset defining a cover having an inner surface defining a chamber; and an inner cover positioned within the chamber, the inner cover being filled solely with a fill material such that the fill material is spaced apart from the panels and the gusset, wherein the gusset comprises a plurality of colinear portions, a first colinear portion having a first number of ports and a second colinear portion that is not colinear with the first colinear portion having a second number of ports that is less than the first number of ports, the second number of ports being greater than zero, wherein an interface between the first panel and the gusset comprises a zipper configured to provide access to the chamber, wherein the open cell construction is formed by spaced apart strands that are not connected at points of intersection to permit free movement between contacting strands, wherein the fill material consists of a foam material, and wherein the first and second panels each comprise a portal extending through a base material thereof that has a porosity greater than a porosity of the base material, and wherein the pillow is configured to have air enter the cover through the first and second panels and have the air exit the cover through the ports.

28. A pillow consisting of:

a first panel having an edge defining a perimeter;

a second panel having an edge defining a perimeter; and a gusset joining the first and second panels, the gusset comprising a single row of ports each extending through the structure of the gusset, the ports being positioned between the first ends, between the second ends, between the third ends and between the fourth ends, the pillow comprising a breathable material that is coupled to the gusset and covers each of the ports, wherein inner surfaces of the first and second panels and the gusset define a cavity, a fill material being disposed in the cavity, the fill material consisting of a foam material, wherein the gusset is formed from an open cell construction and comprises a plurality of colinear portions, a first colinear portion having a first number of ports and a second colinear portion that is not colinear with the first colinear portion having a second number of ports that is less than the first number of ports, the second number of ports being greater than zero, the open cell construction being formed by spaced apart strands that are not connected at points of intersection to permit free movement between contacting strands, and wherein the ports being configured to allow a greater amount of air flow in and out of the cavity at areas of the pillow that include the ports relative to areas of the pillow that do not include the ports.

29. A pillow consisting of:

a first panel having an edge defining a perimeter;

a second panel having an edge defining a perimeter; and a gusset joining the first and second panels, the gusset comprising a single row of ports, the ports each extending through a thickness of the gusset, the row extending about the perimeters, the pillow comprising a mesh material that covers each of the ports, wherein inner surfaces of the first and second panels and the gusset define a cavity, a fill material being disposed in the cavity, the fill material consisting of a foam material, wherein the gusset is formed from an open cell construction and comprises a plurality of colinear portions, a first colinear portion having a first number of ports and a second colinear portion that is not colinear with the first colinear portion having a second number of ports that is less than the first number of ports, the second number of ports being greater than zero, the open cell construction being formed by spaced apart strands that are not connected at points of intersection to permit free movement between contacting strands, and wherein the ports are configured to allow a greater amount of air flow in and out of the cavity at areas of the pillow that include the ports relative to areas of the pillow that do not include the ports.

* * * * *